US010473113B2

(12) United States Patent
Usami et al.

(10) Patent No.: US 10,473,113 B2
(45) Date of Patent: Nov. 12, 2019

(54) CENTRIFUGAL BLOWER

(71) Applicant: DENSO CORPORATION, Kariya, Aichi-pref. (JP)

(72) Inventors: Hiroyuki Usami, Kariya (JP); Masaharu Sakai, Kariya (JP); Sho Kosaka, Kariya (JP); Yohei Kamiya, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 223 days.

(21) Appl. No.: 15/371,263

(22) Filed: Dec. 7, 2016

(65) Prior Publication Data

US 2017/0175764 A1 Jun. 22, 2017

(30) Foreign Application Priority Data

Dec. 16, 2015 (JP) ..... 2015-245428
Mar. 31, 2016 (JP) ..... 2016-070722

(51) Int. Cl.

| | |
|---|---|
| ***F04D 29/42*** | (2006.01) |
| ***F04D 13/06*** | (2006.01) |
| ***F04D 17/16*** | (2006.01) |
| ***F04D 29/053*** | (2006.01) |
| ***F04D 29/28*** | (2006.01) |
| ***F04D 29/16*** | (2006.01) |

(52) U.S. Cl.

CPC ..... *F04D 29/4226* (2013.01); *F04D 13/06* (2013.01); *F04D 17/16* (2013.01);
(Continued)

(58) Field of Classification Search

CPC ..... F04D 29/4226; F04D 13/06; F04D 17/16; F04D 29/053; F04D 29/162;
(Continued)

(56) References Cited

U.S. PATENT DOCUMENTS 3,824,028 A * 7/1974 Zenkner ..... F04D 29/4213 415/182.1
5,511,939 A * 4/1996 Tokunaga ..... B60H 1/00471 415/119
(Continued)

FOREIGN PATENT DOCUMENTS

JP 2001-115991 A 4/2001
JP 2001115997 A 4/2001
(Continued)

*Primary Examiner* — Nathaniel E Wiehe
*Assistant Examiner* — Michael K. Reitz
(74) *Attorney, Agent, or Firm* — Harness, Dickey & Pierce, P.L.C.

(57) ABSTRACT

A centrifugal blower includes a rotation shaft, an impeller, a casing. The impeller includes a plurality of blades and a side panel. The casing accommodates the impeller and includes an air intake portion positioned adjacent to the side panel. The air intake portion includes a downstream end portion and an inner wall surface. The side panel includes an upstream end portion and an inner panel surface that is an inner surface of the side panel. The downstream end portion and the upstream end portion face each other across a space in an angular range. A difference between a smallest inner radius of the inner wall surface of the air intake portion and a smallest inner radius of the inner panel surface is smaller than or equal to a thickness of the side panel in the angular range.

6 Claims, 19 Drawing Sheets

(52) U.S. Cl.
CPC ..... *F04D 29/053* (2013.01); *F04D 29/162* (2013.01); *F04D 29/281* (2013.01)

(58) Field of Classification Search
CPC .. F04D 29/281; F04D 29/441; F04D 29/4253; F04D 29/66; F04D 29/667
USPC ..... 415/203, 204, 205, 206
See application file for complete search history.

(56) References Cited

U.S. PATENT DOCUMENTS

| | | | | |
|---|---|---|---|---|
| 5,570,996 | A * | 11/1996 | Smiley, III | F04D 29/4226 415/204 |
| 6,884,033 | B2 * | 4/2005 | Liao | F04D 29/4213 257/E23.099 |
| 2009/0324402 | A1 * | 12/2009 | Grimm | F04D 29/2288 415/203 |
| 2012/0195747 | A1 * | 8/2012 | Fukuda | F04D 29/162 415/206 |
| 2013/0017079 | A1 * | 1/2013 | Armstrong | A47L 5/14 415/204 |
| 2015/0152875 | A1 | 6/2015 | Kamiya et al. | |
| 2017/0151608 | A1 * | 6/2017 | Isogai | B22D 17/20 |

FOREIGN PATENT DOCUMENTS

| | | | |
|---|---|---|---|
| JP | 2006207595 | A | 8/2006 |
| JP | 2008267265 | A | 11/2008 |
| JP | 2010-053815 | A | 3/2010 |
| JP | 2013-249762 | A | 12/2013 |

* cited by examiner

COMPARATIVE EXAMPLE

CENTRIFUGAL BLOWER

CROSS REFERENCE TO RELATED APPLICATION

This application is based on and incorporates herein by reference Japanese Patent Application No. 2015-245428 filed on Dec. 16, 2015, and Japanese Patent Application No. 2016-070722 filed on Mar. 31, 2016.

TECHNICAL FIELD

The present disclosure relates to a centrifugal blower that draws an air therein from one side of an axial direction of a rotation shaft and discharges the drawn air outward in a radial direction of the rotation shaft.

BACKGROUND

Conventionally, a centrifugal blower is proposed, in which a leakage of an air from a gap between a shroud and a bell mouth of a centrifugal fan is reduced in order to decrease a separation noise on a negative pressure surface of a blade caused by an interference with a main flow (for example, refer to Patent Document 1: JP2001-115991A). Patent Document 1 discloses a labyrinth seal portion provided in a part of the shroud facing to an air intake side end portion of the bell mouth in a blade negative pressure surface area.

SUMMARY

According to a study by the inventors of the present disclosure, in the Patent Document 1, the shroud is positioned radially outside of the bell mouth, and level difference in a radial direction is formed between the bell mouth and the shroud. Therefore, an air flowing along an inner surface of the bell mouth is separated therefrom at a downstream end portion of the bell mouth, and the air may not flow along an inner surface of the shroud. According to this, turbulence is generated in the air flowing from the surface of the bell mouth into a vicinity of the shroud of the fan. The turbulence grows as the air moves to a downstream side of the fan and may cause an increase of noise and decrease of a blowing efficiency.

It is an objective of the present disclosure to provide a centrifugal blower capable of decreasing noise and improving a blowing efficiency.

According to an aspect of the present disclosure, a centrifugal blower includes: a rotation shaft; an impeller having a circular cylindrical shape and rotating about an axis line of the rotation shaft to draw an air therein in an axial direction of the rotation shaft and discharge the air outward in a radial direction of the rotation shaft, the impeller including a plurality of blades arranged radially about the axis line of the rotation shaft, and a side panel having an annular shape and connecting end parts of the plurality of blades in the axial direction of the rotation shaft; and a casing accommodating the impeller and including an air intake portion positioned adjacent to the side panel, the air intake portion having a bell mouth shape through which the drawn air is guided to an inside of the impeller. The air intake portion includes a downstream end portion that is an end portion of the air intake portion located on downstream of an airflow, and an inner wall surface located on an inner side of the air intake portion in the radial direction of the rotation shaft. The side panel includes an upstream end portion that is an end portion of the side panel located on upstream of the airflow, and an inner panel surface that is an inner surface of the side panel located on an inner side of the side panel in the radial direction of the rotation shaft. The downstream end portion and the upstream end portion face each other across a space in the axial direction of the rotation shaft at least in an angular range in the rotation direction. A difference between a smallest inner radius of the inner wall surface of the air intake portion and a smallest inner radius of the inner panel surface is smaller than or equal to a thickness of the side panel at least in the angular range.

Accordingly, since the difference between the smallest inner radius of the inner wall surface of the air intake portion and the smallest inner radius of the inner panel surface is smaller than or equal to the thickness of the side panel at least in the angular range, substantially no level difference in the radial direction between the inner wall surface of the air intake portion and the inner panel surface portion of the side panel. Therefore, an air flowing along the air intake portion is likely to flow to the side panel smoothly. Accordingly, the centrifugal blower is capable of reducing noise and improving the blowing efficiency. The air intake portion having the bell mouth shape means that a trumpet-shaped air intake portion in which a diameter of the air intake portion becomes large toward the upstream side of the airflow.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
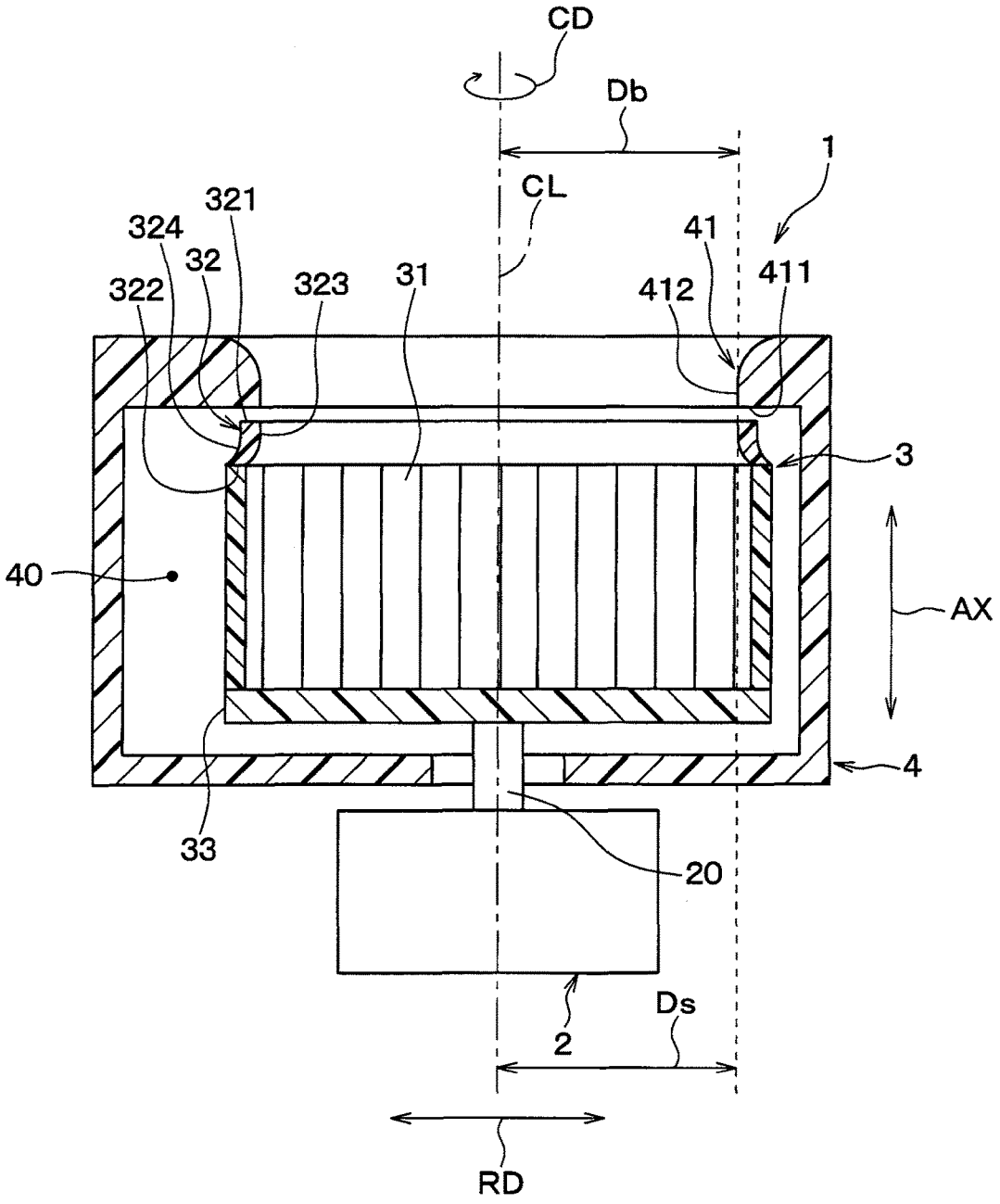
FIG. 1 is a sectional diagram taken in an axial direction illustrating a centrifugal blower according to a first embodiment of the present disclosure.

Embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment will be described below referring to FIGS. 1 to 7. A centrifugal blower 1 of the present embodiment shown in FIG. 1 is used in a blowing unit that sends air to an interior unit of a vehicular air conditioning device, for example.

The centrifugal blower 1 includes an electric motor 2 having a rotation shaft 20, an impeller 3 rotationally driven by the electric motor 2 to discharge an air, and a casing 4 accommodating the impeller 3. An arrow AX shown in FIG. 1 indicates an axial direction along an axis line CL of the rotation shaft 20. An arrow CD shown in FIG. 2 indicates a rotation direction of the rotation shaft 20. An arrow RD shown in FIG. 2 indicates a radial direction that is perpendicular to the axial direction AX of the rotation shaft 20. These are the same in the other drawings.

The impeller 3 has a circular cylindrical shape and rotates about the axis line CL of the rotation shaft 20. The impeller 3 includes a plurality of blades 31 arranged radially about the rotation shaft 20, a side panel 32 having a circular annular shape and connecting end parts of the plurality of blades on one side in the axial direction AX, and a main panel 33 having a disc shape and connecting end parts of the plurality of blades on the other side in the axial direction AX.

The impeller 3 of the present embodiment includes a multi-blade centrifugal fan (sirocco fan) in which each blade 31 is a forward-curved blade. The blades 31 are arranged radially about the axis line CL of the rotation shaft 20. An airflow pathway in which the air flows is provided between blades 31 next to each other.

The side panel 32 is formed of a component having a circular annular shape in which a center part is opened. A thickness Th of the side panel 32 of the present embodiment is set within 1-3 mm, for example, in order to reduce weight.

The side panel 32 of the present embodiment includes a first end portion 321 that is an end portion located upstream of an airflow, and a second end portion 322 that is an end portion located downstream of the airflow. Moreover, the side panel 32 includes an inner panel surface portion 323 that is an inner surface in the radial direction RD of the rotation shaft 20, and an outer surface portion 324 that is an outer surface in the radial direction RD. In the present embodiment, the first end portion 321 of the side panel 32 is an upstream end portion. The side panel 32 is connected to end parts of the blades 31 on the one side in the axial direction AX. The inner panel surface portion 323 may be an inner panel surface of the side panel 32.

The inner panel surface portion 323 defines a guide opening guiding the air drawn from an air intake portion 41 of the casing 4 into the impeller 3. The inner panel surface portion 323 of the present embodiment is convex inward in the radial direction RD of the rotation shaft 20 such that the air drawn in the axial direction AX of the rotation shaft 20 is guided outward in the radial direction RD of the rotation shaft 20. Specifically, a radius of the inner panel surface portion 323 gradually increases in size from the first end portion 321 toward the second end portion 322. In the present embodiment, a radius at the first end portion 321 is the smallest in the inner panel surface portion 323.

The main panel 33 is connected to the rotation shaft 20 at its center part. A part of the main panel 33 facing to the side panel 32 is connected to end parts of the blades 31 on the other side in the axial direction AX. The main panel 33 of the present embodiment has a flat circular shape. The main panel 33 may have a circular cone shape that is convex toward the side panel 32 in the axial direction AX.

The casing 4 accommodates the impeller 3. The casing 4 of the present embodiment is a scroll casing that defines an airflow passage 40 having a volute shape outside the impeller 3. The casing 4 includes the air intake portion 41 having a bell mouth shape and guiding the air into the impeller 3.

The air intake portion 41 is provided in a part of the casing 4 on the one side in the axial direction AX, and the part is adjacent to the side panel 32 of the impeller 3. The air intake portion 41 includes a downstream end portion 411 that is an end portion located downstream of the airflow, and inner wall surface portion 412 that is an inner wall in the radial direction RD of the rotation shaft 20. The inner wall surface portion 412 may be an inner wall surface of the air intake portion 41.

The air intake portion 41 of the present embodiment is provided in the casing 4 such that the downstream end portion 411 is spaced from and faces to the first end portion 321 of the side panel 32 in the axial direction AX. Therefore, the air intake portion 41 does not overlap the side panel 32 in the radial direction RD of the rotation shaft 20.

The inner wall surface portion 412 is convex inward so as to guide the air into the impeller 3. Specifically, the radius of the inner wall surface portion 412 gradually decreases in size from an upstream side of the airflow toward the downstream end portion 411. In the present embodiment, a radius at the downstream end portion 411 of the air intake portion 41 is the smallest in the inner wall surface portion 412.

In the centrifugal blower 1 of the present embodiment, substantially no level difference in the radial direction RD is provided between the air intake portion 41 and the side panel 32 so as to limit a separation of a main flow of the air flowing from the air intake portion 41 toward the side panel 32. The separation may mean separating of the air from the air intake portion 41 or the side panel 32.

Figure 2:
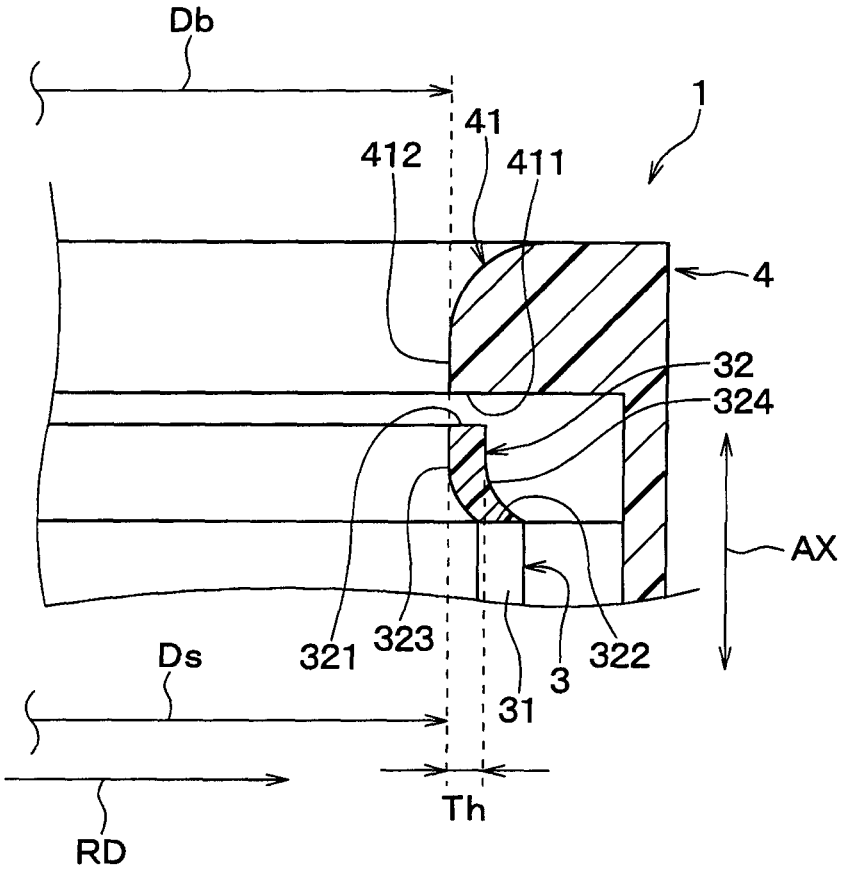
FIG. 2 is a sectional diagram illustrating the centrifugal blower according to the first embodiment.

As shown in FIG. 2, a difference in size between a radius Db of a part of the air intake portion 41 in which a radius is the smallest in size in the inner wall surface portion 412 and a radius Ds of a part of the side panel 32 in which the radius is the smallest in size in the inner panel surface portion 323 is set to be equal to or smaller than the thickness Th of the side panel 32. The radius of the inner wall surface portion 412 of the air intake portion 41 means a distance (e.g. radius) from the inner wall surface portion 412 of the air intake portion 41 to the axis line CL of the rotation shaft 20. The radius of the inner panel surface portion 323 of the side panel 32 means a distance (e.g. radius) between the inner panel surface portion 323 of the side panel 32 and the axis line CL of the rotation shaft 20. The radius Db may be a first radius, and the radius Ds may be a second radius. The first radius may be the smallest radius in the inner wall surface portion 412 in a cross section including the rotation shaft 20 taken along the axial direction, and the second radius may be the smallest radius in the inner panel surface portion 323 in the cross section. The radius Db may be a smallest inner radius of the inner wall surface portion 412, and the radius Ds may be a smallest inner radius of the inner panel surface portion 323.

In the present embodiment, as described above, a part of the air intake portion 41 in which the radius is the smallest in size in the inner wall surface portion 412 is the downstream end portion 411, and a part of the side panel 32 in which a radius is the smallest in size in the inner panel surface portion 323 is the first end portion 321.

Accordingly, a difference in size between the radius Db of the downstream end portion 411 of the air intake portion 41 and the radius Ds of the first end portion 321 of the side panel 32 is set to be equal to or smaller than the thickness Th of the side panel 32. The thickness Th of the side panel 32 is a thickness of a part of the side panel 32 that is adjacent to the air intake portion 41.

In the present embodiment, the radius Db of the downstream end portion 411 of the air intake portion 41 is set to be equal or smaller in size than the radius Ds of the first end portion 321 of the side panel 32 entirely in the rotation direction CD. Specifically, the radius Db of the downstream end portion 411 of the air intake portion 41 is set to be substantially equal in size to the radius Ds of the first end portion 321 of the side panel 32 entirely in the rotation direction CD.

The air intake portion 41 and the side panel 32 are set such that a tangent line to the air intake portion 41 at the downstream end portion 411 and a tangent line to the side panel 32 at the first end portion 321 are substantially parallel. Specifically, in the present embodiment, both the tangent line to the air intake portion 41 at the downstream end portion 411 and the tangent line to the side panel 32 at the first end portion 321 are set so as to extend along the axial direction AX of the rotation shaft 20. Accordingly, even if a separation of the airflow occurs at the downstream end portion 411 of the air intake portion 41, the separated airflow is likely to reattach at first end portion 321 of the side panel 32.

An air intake side of the impeller 3 and an air discharge side of the impeller 3 communicate with each other through a gap between the air intake portion 41 and the side panel 32. Therefore, the air discharged from the air discharge side of the impeller 3 may flow back to the air intake side of the impeller 3 through the gap between the air intake portion 41 and the side panel 32. In the present embodiment, the gap between the air intake portion 41 and the side panel 32 is a backflow passage through which the air flows from the air discharge side to the air intake side of the impeller 3.

In the present embodiment, a part of the downstream end portion 411 facing the first end portion 321 extends in the radial direction RD of the rotation shaft 20. The first end portion 321 of the side panel 32 of the present embodiment faces to the downstream end portion 411 of the air intake portion 41 and extends in the radial direction RD of the rotation shaft 20. Accordingly, the gap between the air intake portion 41 and the side panel 32 that is the backflow passage extends in the radial direction RD of the rotation shaft 20.

Figure 3:
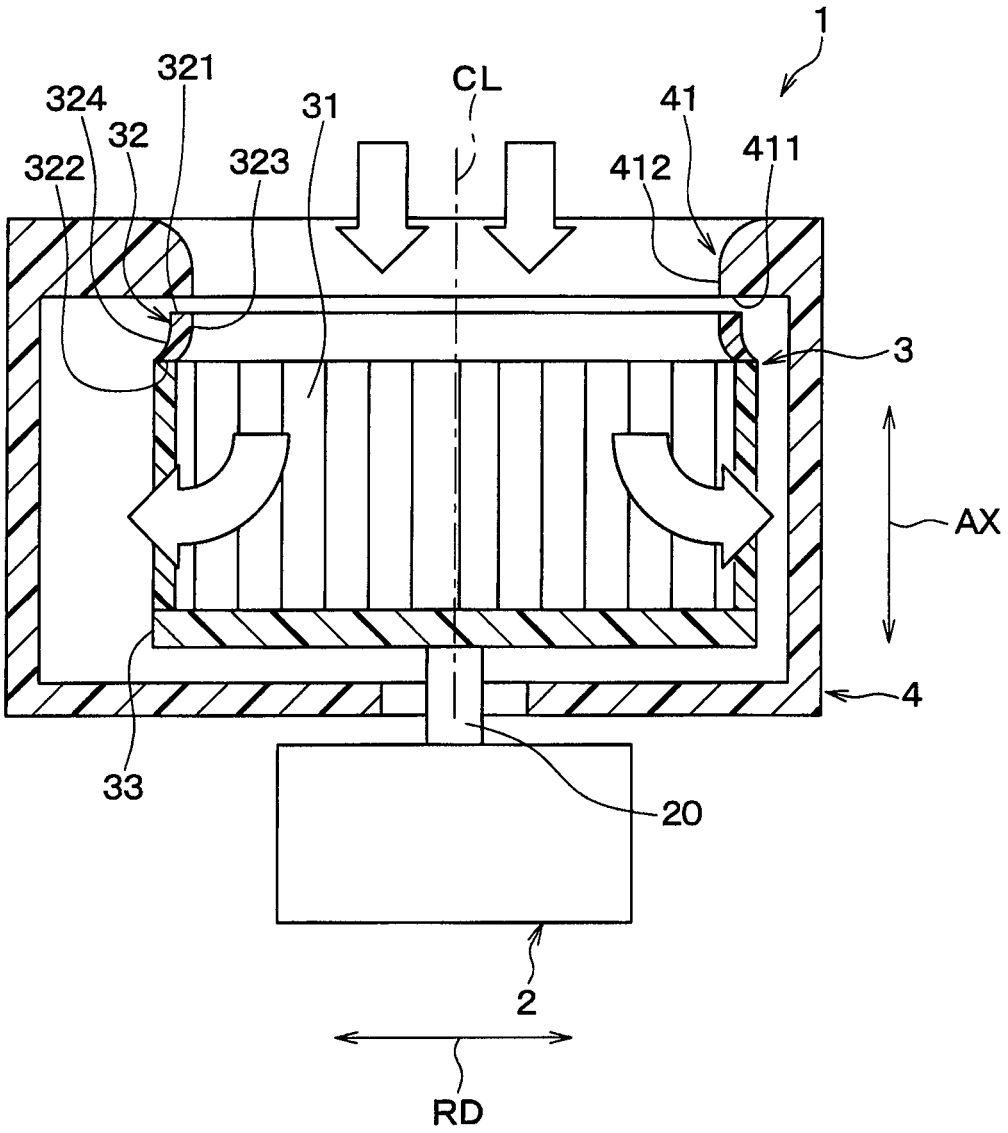
FIG. 3 is a sectional diagram illustrating the centrifugal blower according to the first embodiment.

Next, actuations of the centrifugal blower 1 of the present embodiment will be described below. The impeller 3 of the centrifugal blower 1 rotates according to a rotation of the rotation shaft 20 of the electric motor 2. Thus, the air drawn into the impeller 3 from the one side of the axial direction AX of the rotation shaft 20 is discharged outward in the radial direction RD of the rotation shaft 20 by centrifugal force as shown in FIG. 3.

Figure 4:
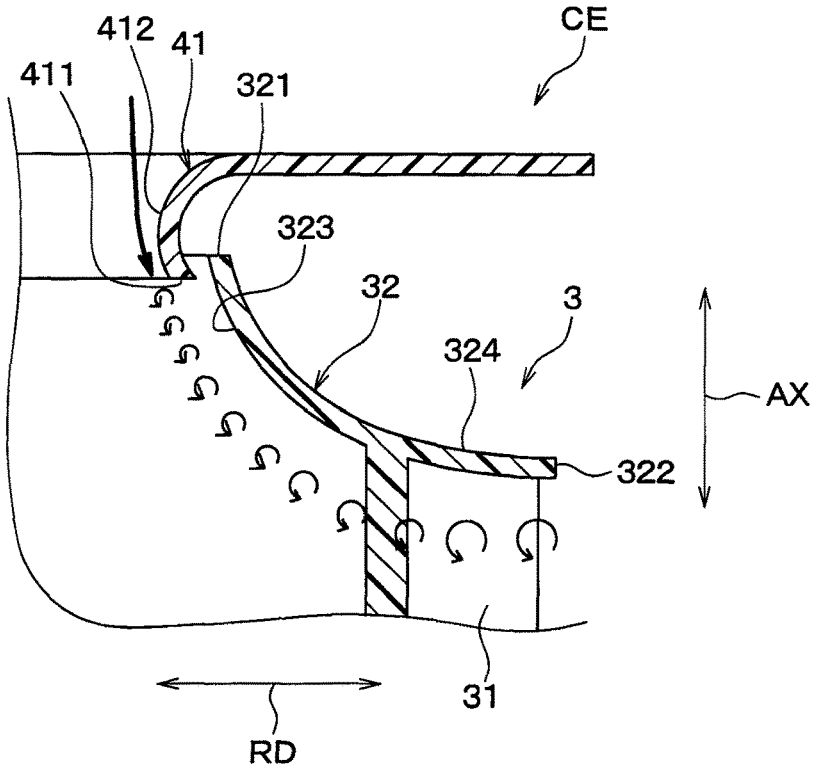
FIG. 4 is a sectional diagram illustrating a centrifugal blower according to a comparative example.

FIG. 4 illustrates an airflow in a vicinity of a side panel 32 of a centrifugal blower CE according to a comparative example of the present disclosure. The centrifugal blower CE is different from the centrifugal blower 1 of the present embodiment in a point where the side panel 32 is positioned on an outer side of the air intake portion 41 in a radial direction RD.

In the centrifugal blower CE of the comparative example, an air is drawn from one side of an axial direction AX of the rotation shaft 20 into an impeller 3 by a rotation of the impeller 3. In the centrifugal blower CE of the comparative example, since a large level difference in a radial direction RD is provided between the air intake portion 41 and the side panel 32, an air flowing along a surface of the air intake portion 41 is separated at a downstream end portion 411 of the air intake portion 41. Accordingly, a turbulence including a parallel vortex is generated in the air flowing from the surface of the air intake portion 41 into a vicinity of the side panel 32 of the impeller 3. The turbulence grows as the airflow moves to a downstream side in the impeller 3. Consequently, a noise may increase, and a blowing efficiency may decrease. The parallel vortex is a vortex having a center axis of a rotation intersecting with a flow direction of a main flow of the air.

On the other hand, in the centrifugal blower 1 of the present disclosure, the difference in size between the radius Db of the part of the inner wall surface portion 412 of the air intake portion 41 having the smallest size therein and the radius Ds of the part of the inner panel surface portion 323 of the side panel 32 having the smallest size therein is set to be equal to or smaller than the thickness Th.

Figure 5:
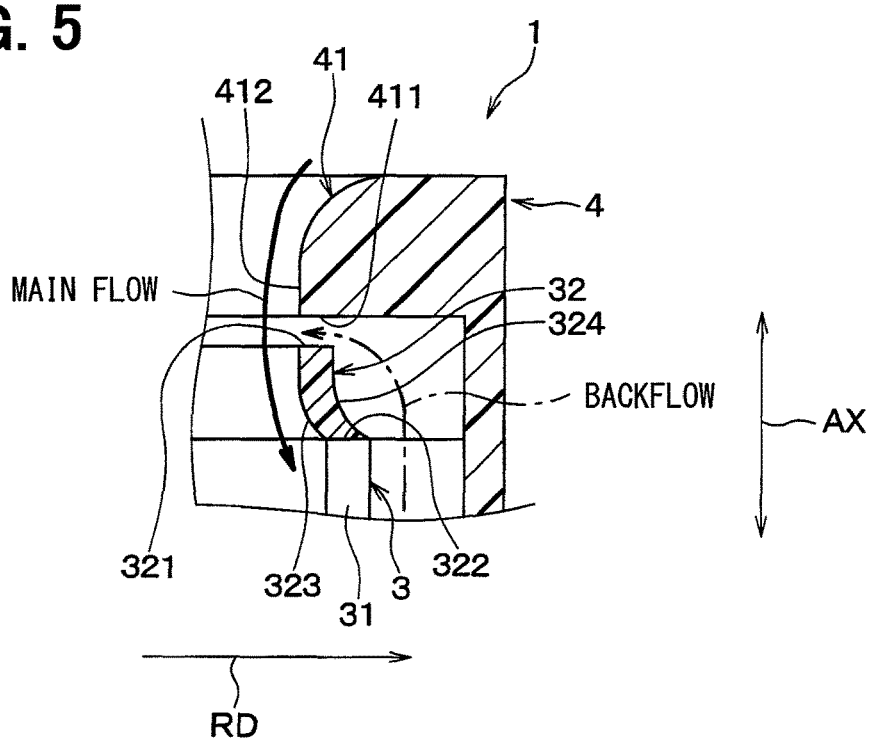
FIG. 5 is a sectional diagram illustrating the centrifugal blower according to the first embodiment.

Therefore, in the centrifugal blower 1 of the present embodiment, the air flowing along the surface of the air intake portion 41 reattaches to the side panel 32 after being separated from the downstream end portion 411 of the air intake portion 41, as shown in FIG. 5. The airflow in the vicinity of the side panel 32 flows along the side panel 32 without being separated from the side panel 32. In the centrifugal blower 1 of the present embodiment, the air flowing along the air intake portion 41 is likely to flow to the side panel 32 smoothly.

Figure 6:
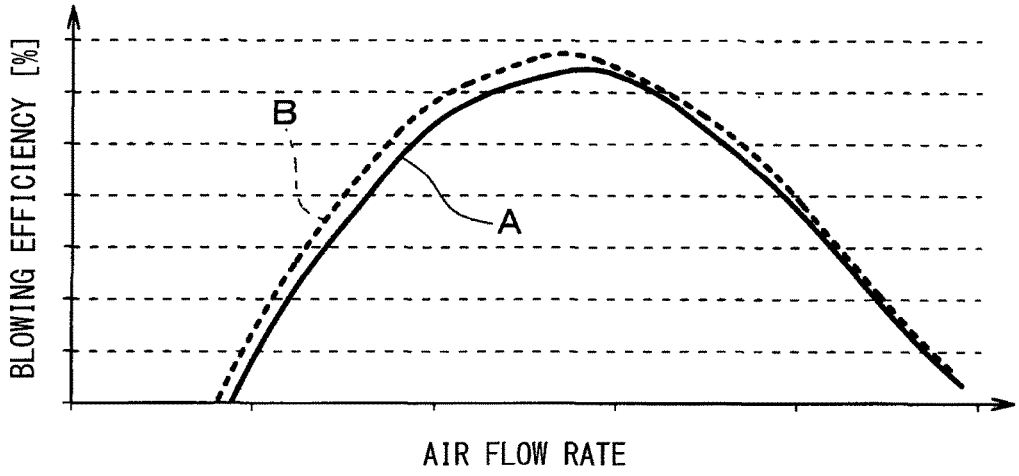
FIG. 6 is a graph showing a relationship between an airflow rate and a blowing effectiveness of the centrifugal blowers of the first embodiment and the comparative example.

FIG. 6 is a graph showing relationships between the amounts of the discharged air and blowing efficiencies of the centrifugal blower 1 of the present embodiment and the centrifugal blower CE of the comparative example. In FIG. 6, the blowing efficiency of the centrifugal blower CE of the comparative example is illustrated by solid line A, and the blowing efficiency of the centrifugal blower 1 of the present embodiment if illustrated by dashed line B.

Figure 7:
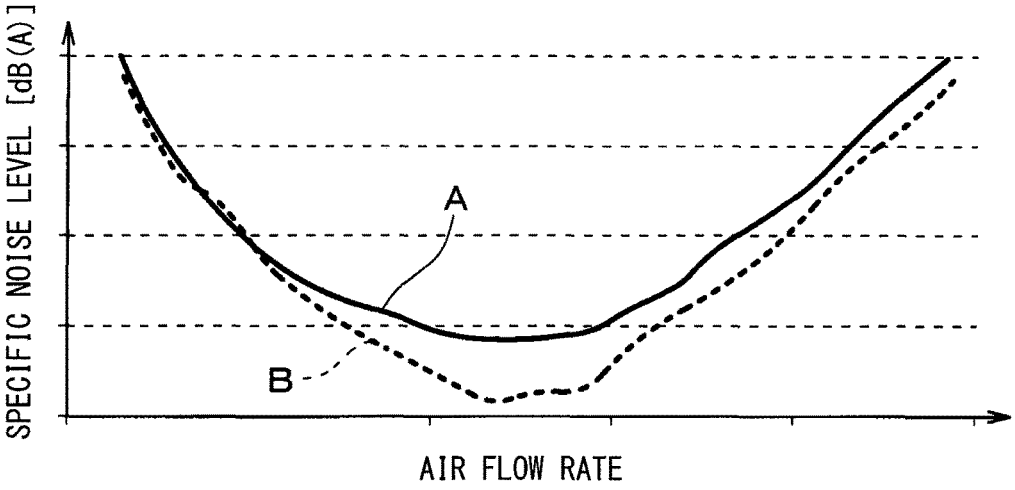
FIG. 7 is a graph showing a relationship between an airflow rate and a specific noise level of the centrifugal blowers of the first embodiment and the comparative example.

FIG. 7 is a graph showing relationships between the amounts of the discharged air and specific noise levels of the centrifugal blower 1 of the present embodiment 1 and the centrifugal blower CE of the comparative example. In FIG. 7, the specific noise level of the centrifugal blower CE of the comparative example is illustrated by solid line A, and the specific noise level of the centrifugal blower 1 of the present embodiment is illustrated by dashed line B.

As shown in FIG. 6, the blowing efficiency of the centrifugal blower 1 of the present embodiment is higher than that of the centrifugal blower CE of the comparative example in the entire range of the amount of the discharged air. Moreover, as shown in FIG. 7, the centrifugal blower 1 of the present embodiment generates small noise compared to the noise generated by the centrifugal blower CE of the comparative example in the entire range of the amount of the air. The centrifugal blower 1 of the present embodiment is capable of reducing the noise and improving the blowing efficiency.

In the centrifugal blower 1 of the present embodiment, the difference in size between the radius of the part of the inner wall surface portion 412 of the air intake portion 41 having a radius smallest in the inner wall surface portion 412 and the radius of the part of the inner panel surface portion 323 of the side panel 32 having a radius smallest in the inner panel surface portion 323 is equal to or smaller than the thickness Th of the side panel 32, as described above.

Accordingly, substantially no level difference in the radial direction RD is provided between the inner wall surface portion 412 of the air intake portion 41 and the inner panel surface portion 323 of the side panel 32. According to this, the air flowing along the air intake portion 41 is likely to flow to the side panel 32 smoothly. Therefore, the noise can be reduced, and the blowing efficiency can be improved according to the centrifugal blower 1 of the present embodiment.

Furthermore, in the centrifugal blower 1 of the present embodiment, the radius Db of the downstream end portion 411 of the air intake portion 41 and the radius Ds of the first end portion 321 of the side panel 32 are set to be equal in size to each other. According to this, since the air flowing along the air intake portion 41 is prevented from hitting against the side panel 32, the air flowing along the air intake portion 41 is more likely to flow to the side panel 32 smoothly.

First Modification of First Embodiment

A first modification of the first embodiment will be described below referring to FIGS. 8 and 9. In the first modification, a radius of the part of the inner wall surface portion 412 having the smallest radius therein is different in size from a radius of the part of the inner panel surface portion 323 having the smallest therein.

Figure 8:
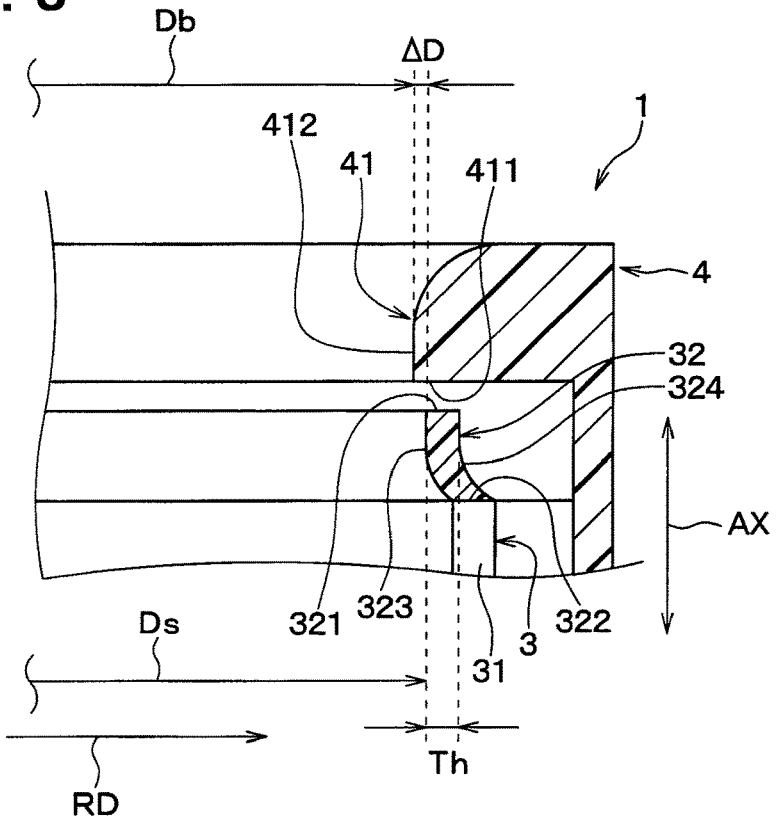
FIG. 8 is a sectional diagram illustrating a centrifugal blower according to a first modification of the first embodiment.
Figure 9:
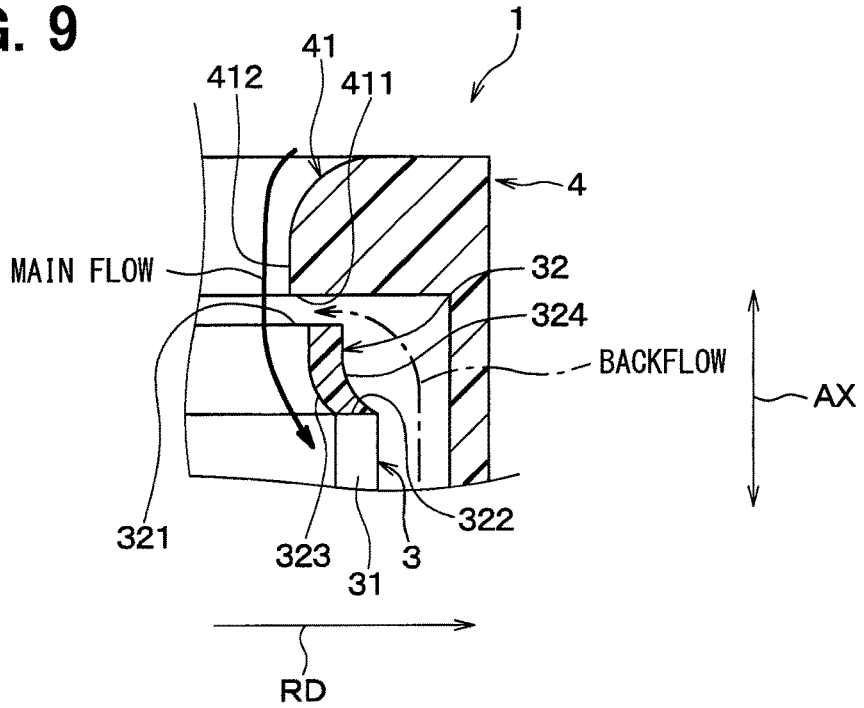
FIG. 9 is a sectional diagram illustrating the centrifugal blower according to the first modification of the first embodiment.

In this modification, the radius Db of the downstream end portion 411 of the air intake portion 41 is set to be smaller than the radius Ds of the first end portion 321 of the side panel 32 (Db<Ds), as shown in FIG. 8. In this modification also, a difference AD in size between the radius of the part of the inner wall surface portion 412 of the air intake portion 41 having a radius smallest therein and the radius of the part of the inner panel surface portion 323 of the side panel 32 having a radius smallest therein is set to be equal to or smaller than the thickness Th of the side panel 32.

Other configurations are the same as the first embodiment. In the centrifugal blower 1 of this modification, the air flowing along the surface of the air intake portion 41 reattaches to the side panel 32 after being separated from the downstream end portion 411 of the air intake portion 41, and the air flows along the side panel 32 without being separated from the side panel 32, as shown in FIG. 9. Accordingly, the centrifugal blower 1 of this modification is also capable of reducing the noise and improving the blowing efficiency.

Second Modification of First Embodiment

Figure 10:
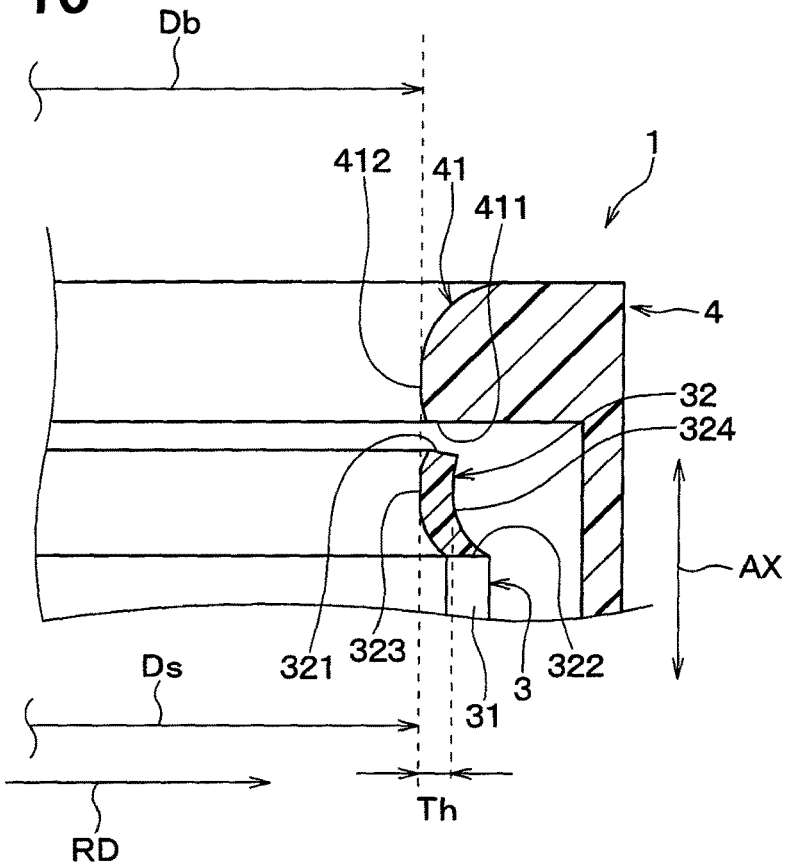
FIG. 10 is a sectional diagram illustrating a centrifugal blower according to a second modification of the first embodiment.
Figure 11:
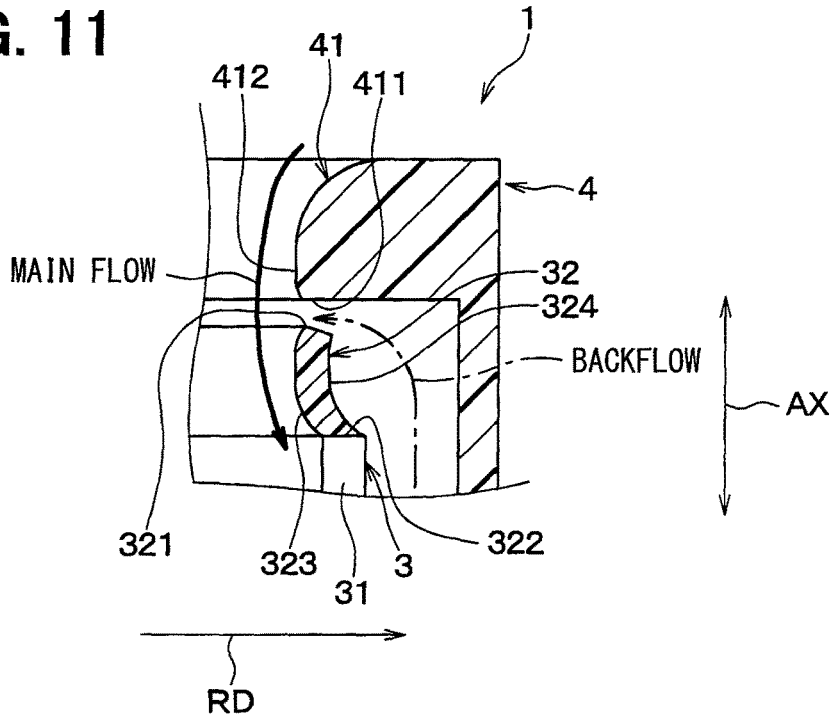
FIG. 11 is a sectional diagram illustrating the centrifugal blower according to the second modification of the first embodiment.

In a second modification of the present embodiment, shapes of the inner wall surface portion 412 and the inner panel surface portion 323 of the side panel 32 are modified, as shown in FIGS. 10 and 11.

In the air intake portion 41 of this modification, the part having a radius smallest in the inner wall surface portion 412 is positioned upstream of the downstream end portion 411 as shown in FIG. 10. Accordingly, the radius of the downstream end portion 411 is larger than the radius of the part of the inner wall surface portion 412 located upstream of the downstream end portion 411.

In the side panel 32 of this modification, the part having a radius smallest in the inner panel surface portion 323 is positioned between the first end portion 321 and the second end portion 322. Accordingly, in the inner panel surface portion 323 of this modification, the radius of the first or the second end portion 321, 322 of this modification is larger than the radius of the part located between the first end portion 321 and the second end portion 322.

The difference in size between the radius Db of the part of the inner wall surface portion 412 of the air intake portion 41 having the radius smallest therein and the radius Ds of the part of the inner panel surface portion 323 of the side panel 32 having the radius smallest therein is set to be equal to or smaller than the thickness Th of the side panel 32.

In this modification, a tangent line to the air intake portion 41 at the part having the radius smallest in the inner wall surface portion 412 and a tangent line to the side panel 32 at the part having the radius smallest in the inner panel surface portion 323 are set to be substantially parallel to each other. Specifically, in this modification, both the tangent line to the part having the radius smallest in the inner wall surface portion 412 and the tangent line to the part having the radius smallest in the inner panel surface portion 323 are set to extend in a direction along the axial direction AX of the rotation shaft 20.

The other configurations of this modification are the same as the first embodiment. The air flowing along the air intake portion 41 reattaches to the side panel 32 after being separated from the downstream end portion 411 of the air intake portion 41, and the air flows along the side panel 32 flows without being separated from the side panel 32, as shown in FIG. 11. Accordingly, the centrifugal blower 1 of this modification is capable of reducing the noise and improving the blowing efficiency.

Second Embodiment

A second embodiment of the present disclosure will be described below referring to FIGS. 12 and 13. In the present embodiment, a direction of a backflow flowing in a gap between an air intake portion 41 and a side panel 32 is deflected so as to be closer to a direction of a main flow.

Figure 12:
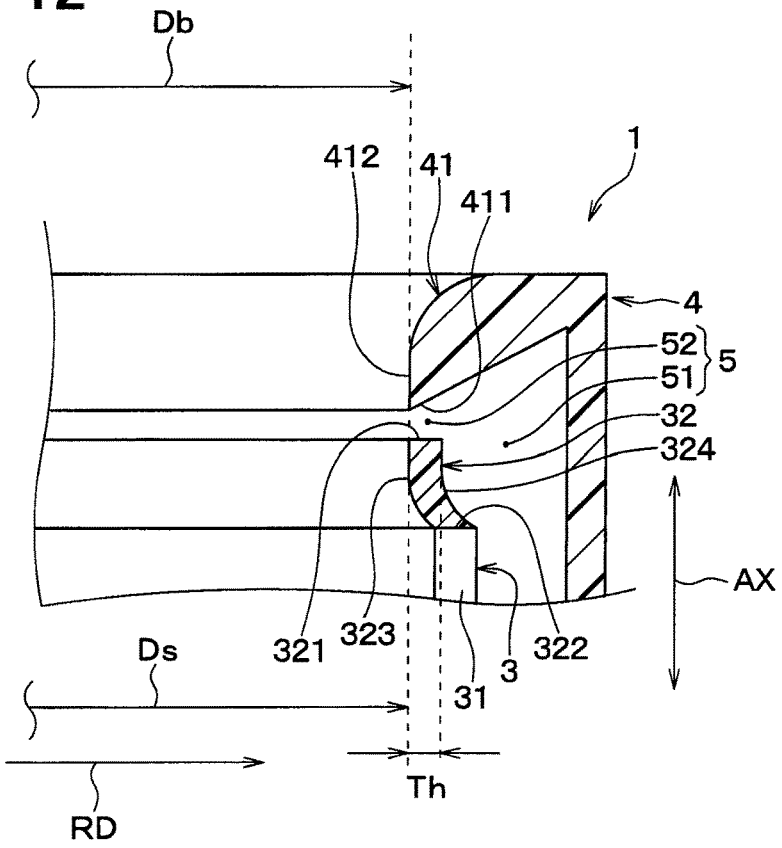
FIG. 12 is a sectional diagram illustrating a centrifugal blower according to a second embodiment.
Figure 13:
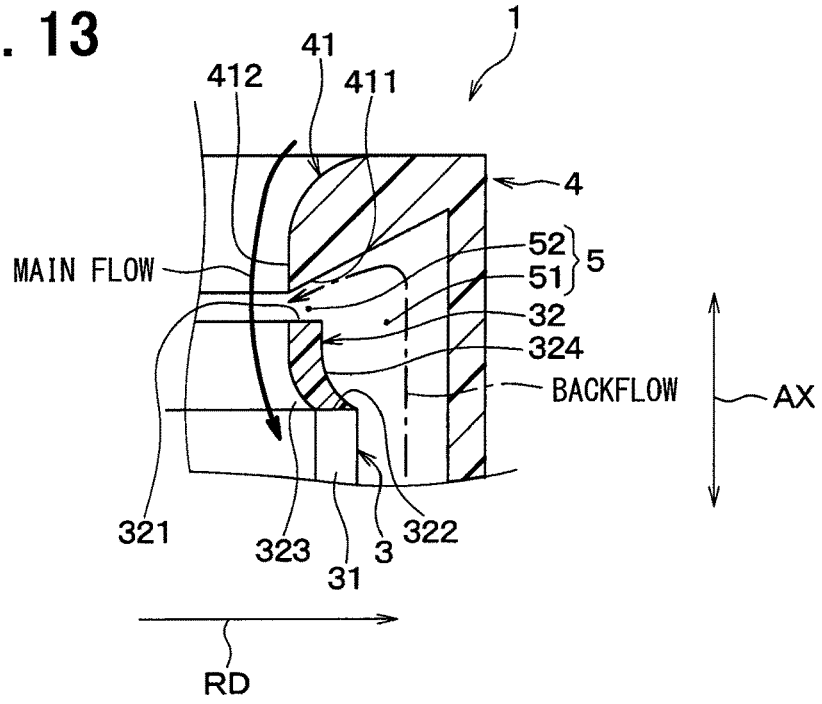
FIG. 13 is a sectional diagram illustrating the centrifugal blower according to the second embodiment.

In a centrifugal blower 1 of the present embodiment, a deflection passage 5 is provided between the air intake portion 41 and the side panel 32, as shown in FIG. 12. The deflection passage 5 deflects the backflow flowing through a gap between a downstream end portion 411 of the air intake portion 41 and a first end portion 321 of the side panel 32 such that the direction of the backflow becomes closer to the direction of the main flow. The backflow is an airflow from the gap between the downstream end portion 411 of the air intake portion 41 and the first end portion 321 of the side panel 32 toward an air intake side of an impeller 3. The main flow is an airflow from the air intake portion 41 to the air intake side of the impeller 3.

The deflection passage 5 includes an upstream passage 51 defined between an outer surface portion 324 of the side panel 32 and an inner wall surface of a casing 4, and a downstream passage 52 defined between the downstream end portion 411 of the air intake portion 41 and the first end portion 321 of the side panel 32.

The downstream end portion 411 of the air intake portion 41 according to this embodiment is angled to an inner wall surface portion 412 such that a radius of a part of the downstream end portion 411 decreases in size toward the first end portion 321. The part of the downstream end portion 411 facing the first end portion 321 of the side panel 32 is angled to intersect with the inner wall surface portion 412 at an acute angle.

In the upstream passage 51 of the present embodiment, a part of the inner wall surface of the casing 4 connected the downstream end portion 411 is angled to the inner wall surface portion 412 similarly to the part of the downstream end portion 411 facing to the first end portion 321 of the side panel 32.

A part of the first end portion 321 of the side panel 32 facing the downstream end portion 411 of the air intake portion 41 extends in a radial direction RD of the rotation shaft 20. Accordingly, a cross sectional area of the downstream passage 52 decreases in size toward a downstream side of the airflow.

The other configurations are the same as the first embodiment. In the centrifugal blower 1 of the present embodiment, the air flowing along the air intake portion 41 flows along the side panel 32 without being separated from the side panel 32 as shown in FIG. 13.

Moreover, in the centrifugal blower 1 of the present embodiment, the deflection passage 5 deflecting the backflow from the gap between the downstream end portion 411 of the air intake portion 41 and the first end portion 321 of the side panel 32 is provided between the air intake portion 41 and the side panel 32 such that the backflow becomes closer to the main flow.

Therefore, the direction of the backflow from the gap between the air intake portion 41 and the side panel 32 becomes a direction along the main flow, and accordingly the interference of the main flow and the backflow can be limited. Accordingly, the airflow along the air intake portion 41 becomes likely to flow to the side panel 32 smoothly, and thus a noise can be reduced, and a blowing efficiency can be improved.

Modification of Second Embodiment

In this modification, an example in which the deflection passage 5 of the downstream passage 52 of the second embodiment is modified will be described below referring to FIGS. 14 and 15.

When an area of a cross section of the downstream passage 52 decreases in size toward a downstream side of an airflow as described in the second embodiment, the passage of the backflow is throttled, and accordingly a turbulence may be likely to be generated in the backflow. This may cause the main flow to be disturbed when the main flow and the backflow join together.

Figure 14:
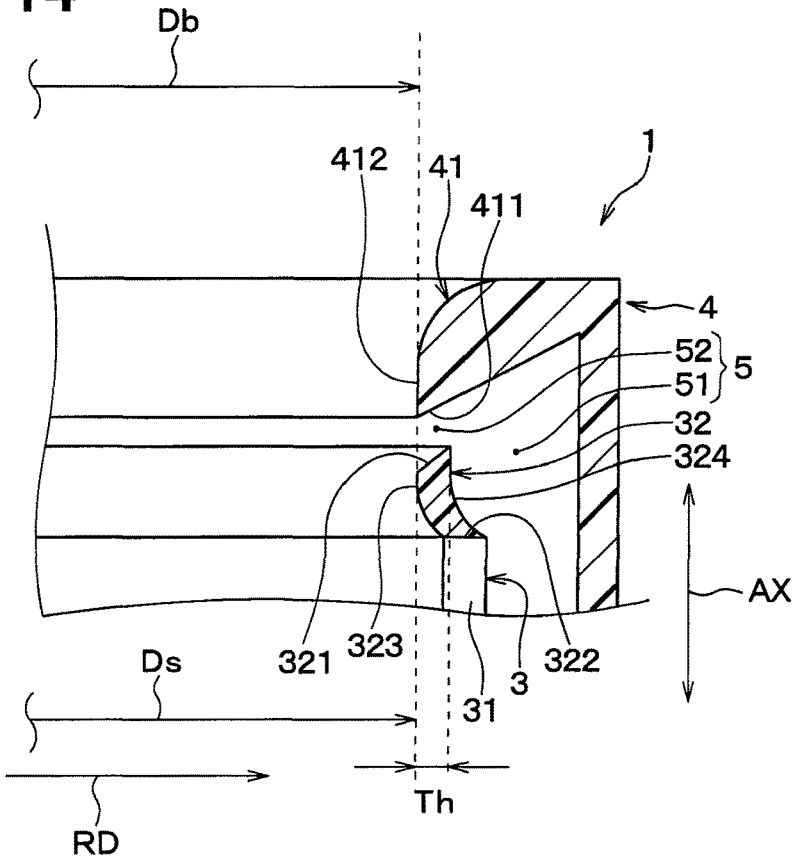
FIG. 14 is a sectional diagram illustrating the centrifugal blower according to the second embodiment.
Figure 15:
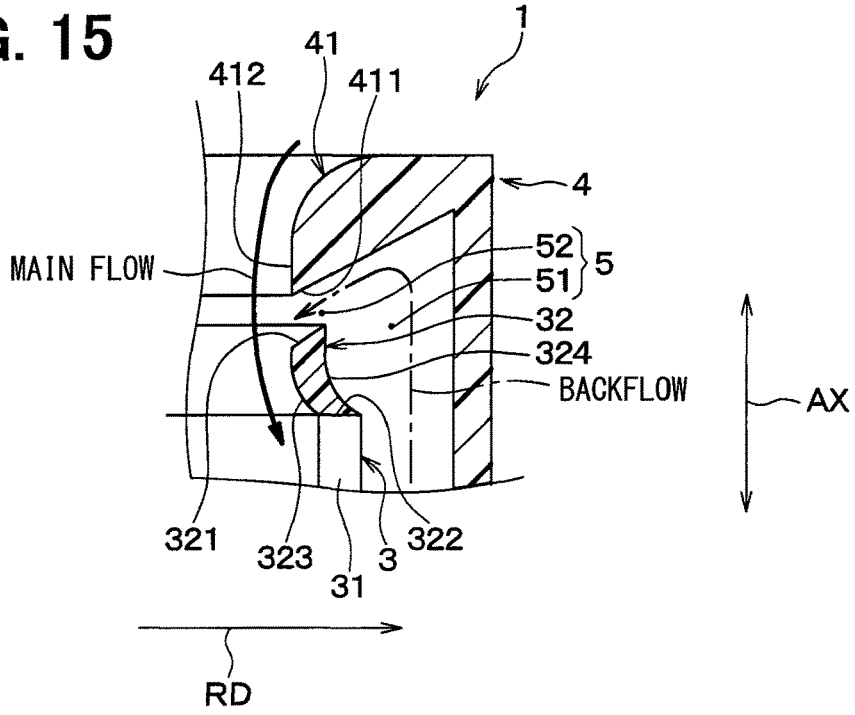
FIG. 15 is a sectional diagram illustrating the centrifugal blower according to the second embodiment.

In this modification, the part of the first end portion 321 of the side panel 32 facing the downstream end portion 411 is angled to the inner panel surface portion 323 as shown in FIG. 14. Specifically, a radius of the part of the first end portion 321 of this modification facing the downstream end portion 411 increase in size toward the downstream end portion 411. The part of the first end portion 321 of the side panel 32 facing the downstream end portion 411 is angled to intersect with the inner panel surface portion 323 at an obtuse angle. Accordingly, the downstream passage 52 has the cross section in which its area on an upstream side is similar in size to its area on a downstream side.

The other configurations are the same as the second embodiment. In the centrifugal blower 1 of this modification, the air flowing along the surface of the air intake portion 41 flows along the side panel 32 without being separated from the side panel 32, as shown in FIG. 15.

In the centrifugal blower 1 of this modification, the downstream passage 52 of the deflection passage 5 has the cross section in which its area on the upstream side is similar in size to its area on the downstream side. Since the turbulence of the backflow flowing through the gap between the air intake portion 41 and the side panel 32 is limited, the turbulence of the main flow generated when the main flow and the backflow join together can be limited effectively.

Third Embodiment

A third embodiment will be described below referring to FIGS. 16 and 17. In the present embodiment, a shape of a deflection passage 5 is different from the second embodiment.

Figure 16:
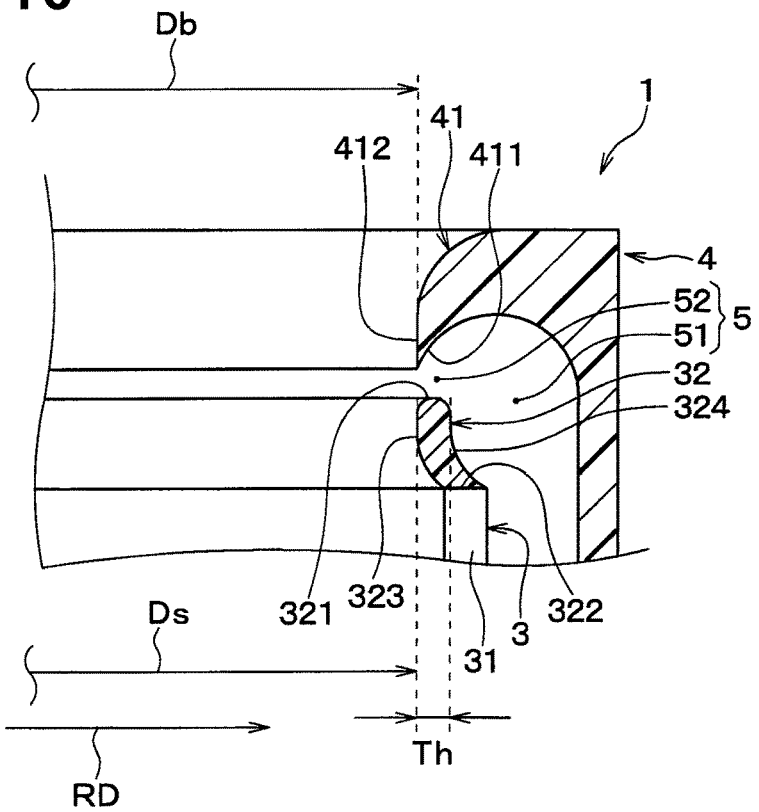
FIG. 16 is a sectional diagram illustrating a centrifugal blower according to a third embodiment.
Figure 17:
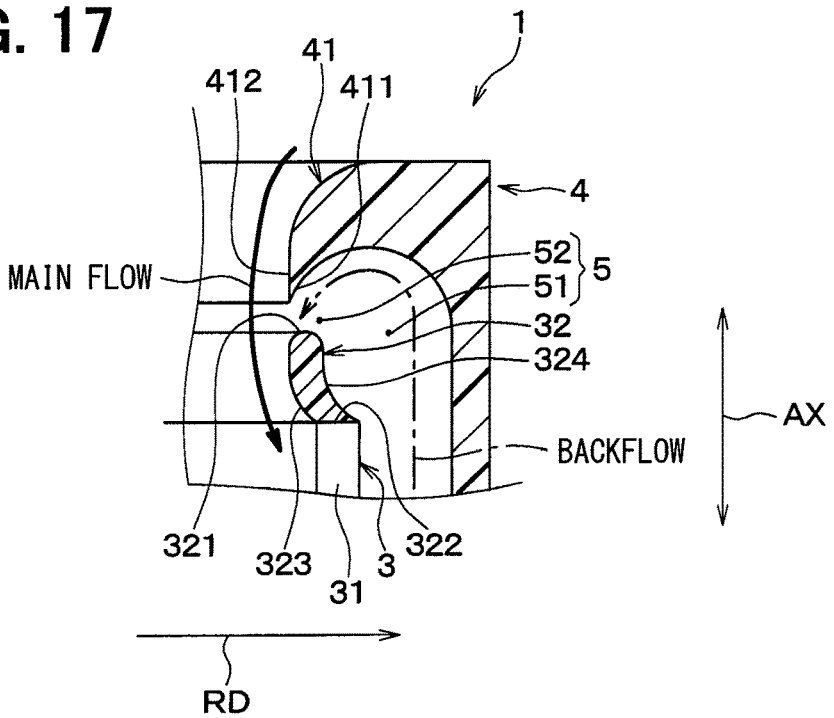
FIG. 17 is a sectional diagram illustrating the centrifugal blower according to the third embodiment.

In a centrifugal blower 1 of the present embodiment, an upstream passage 51 of the deflection passage 5 located between an outer surface portion 324 of a side panel 32 and an inner wall surface of a casing 4 has a rounded shape, as shown in FIG. 16.

Specifically, the inner wall surface of the casing 4 defining the upstream passage 51 has a semicircle shape convex to one side of a rotation shaft 20. A first end portion 321 of the side panel 32 facing a downstream end portion 411 of an air intake portion 41 has a round shape.

The other configurations are same as the second embodiment. In the centrifugal blower 1 of the present embodiment, an air flowing along a surface of the air intake portion 41 flows along the side panel 32 without being separated from the side panel 32, as shown in FIG. 17.

The upstream passage 51 of the deflection passage 5 has a rounded shape in the centrifugal blower 1 of the present embodiment. Therefore, a backflow is likely to flow in the upstream passage 51 of the deflection passage 5 smoothly. Since a turbulence of the backflow flowing through a gap between the air intake portion 41 and the side panel 32 is limited, a turbulence of the main flow generated when the main flow and the backflow join together can be limited effectively.

Fourth Embodiment

A fourth embodiment will be described below referring to FIGS. 18 to 26. In a centrifugal blower 1A of the present embodiment, a difference in size between a radius of a part of an inner wall surface portion 412 of an air intake portion 41 having the smallest radius in the inner wall surface portion 412 and a radius of a part of an inner panel surface portion 323 of a side panel 32 having the smallest radius in the inner panel surface portion 323 is set to be equal to or smaller than a thickness Th of the side panel 32 in a part in a rotation direction CD. The part of the inner wall surface portion 412 and the part of the inner panel surface portion 323 may face to each other.

Figure 18:
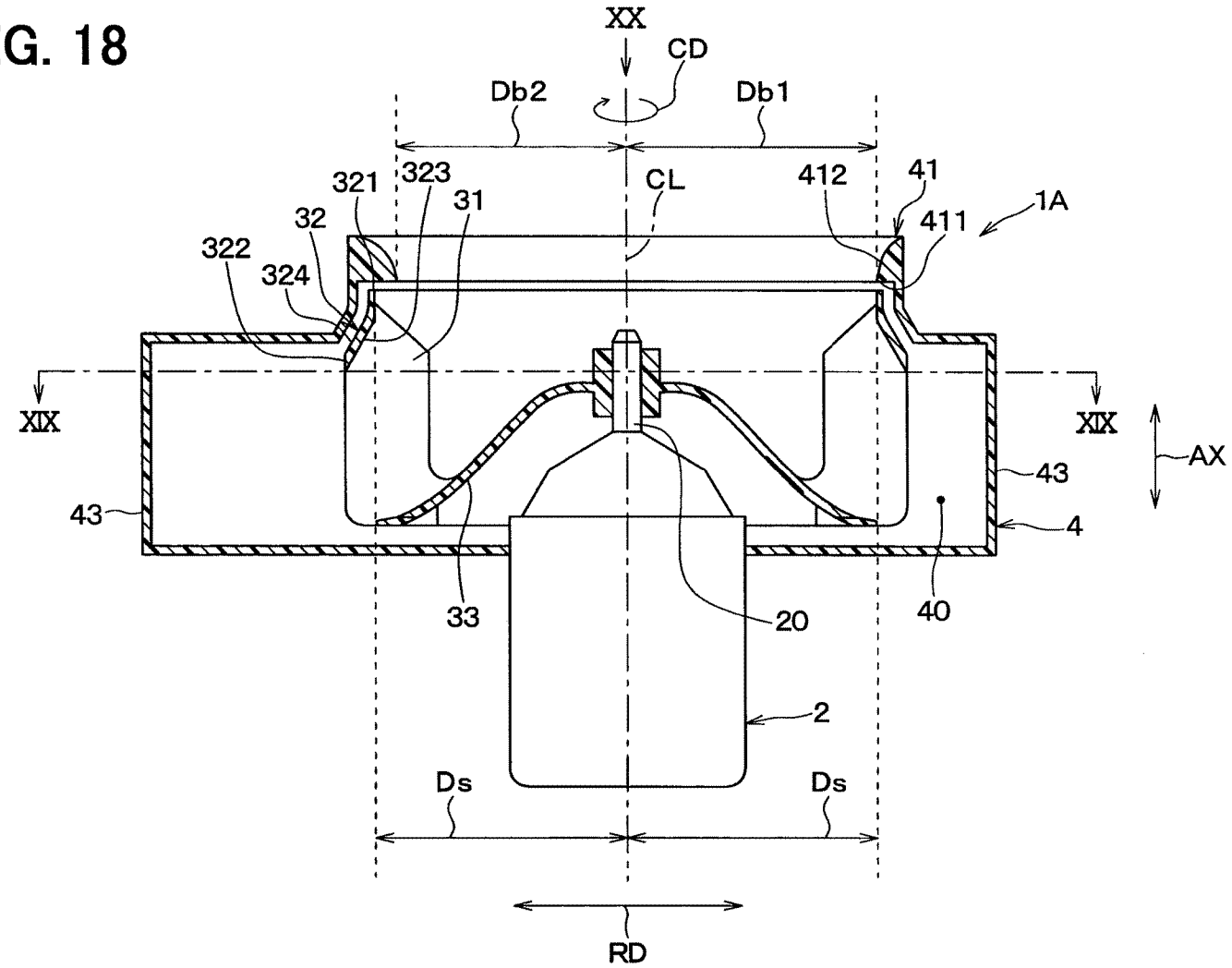
FIG. 18 is a sectional diagram illustrating a centrifugal blower according to a fourth embodiment.
Figure 19:
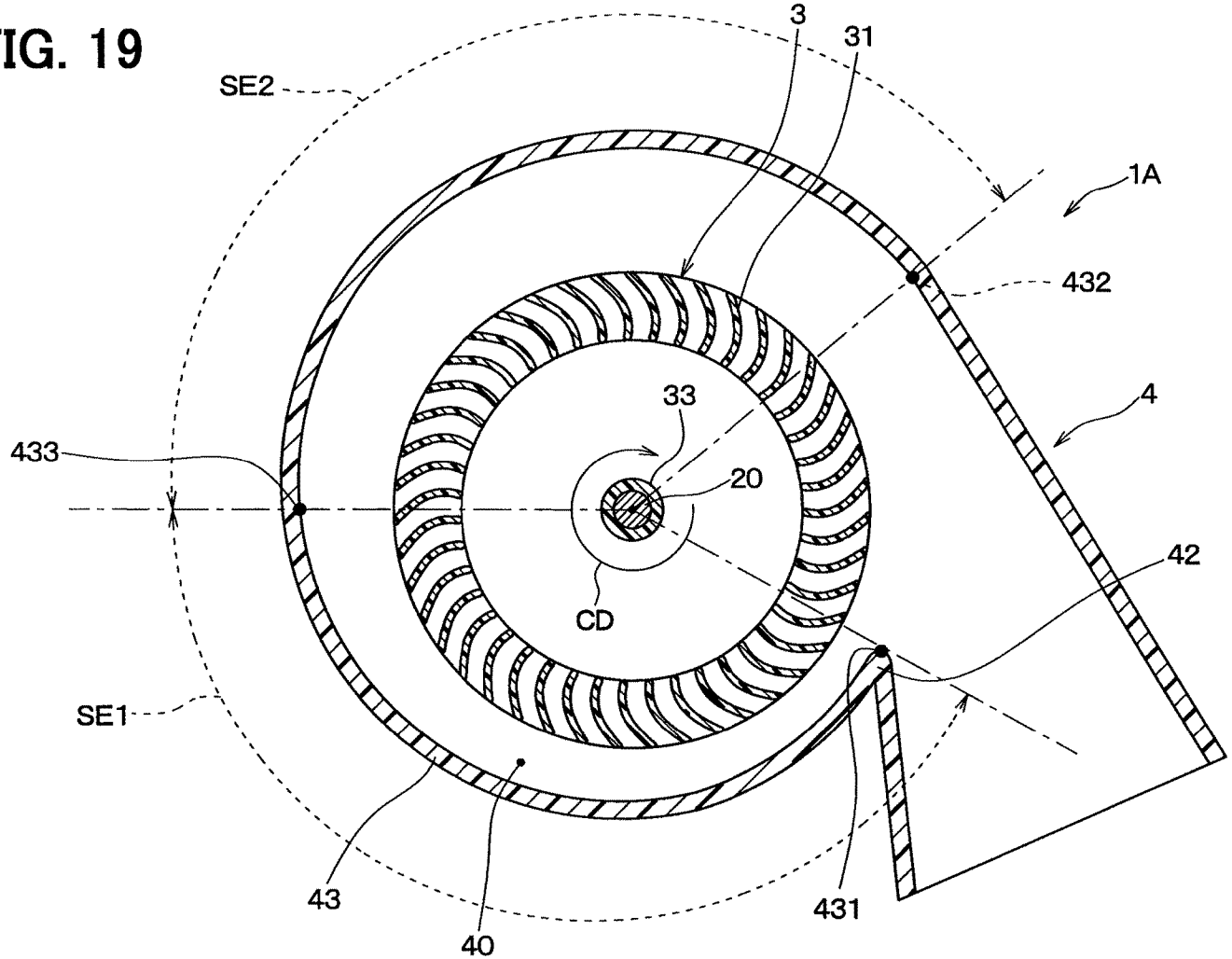
FIG. 19 is a sectional diagram taken along a XIX-XIX line of FIG. 18.
Figure 20:
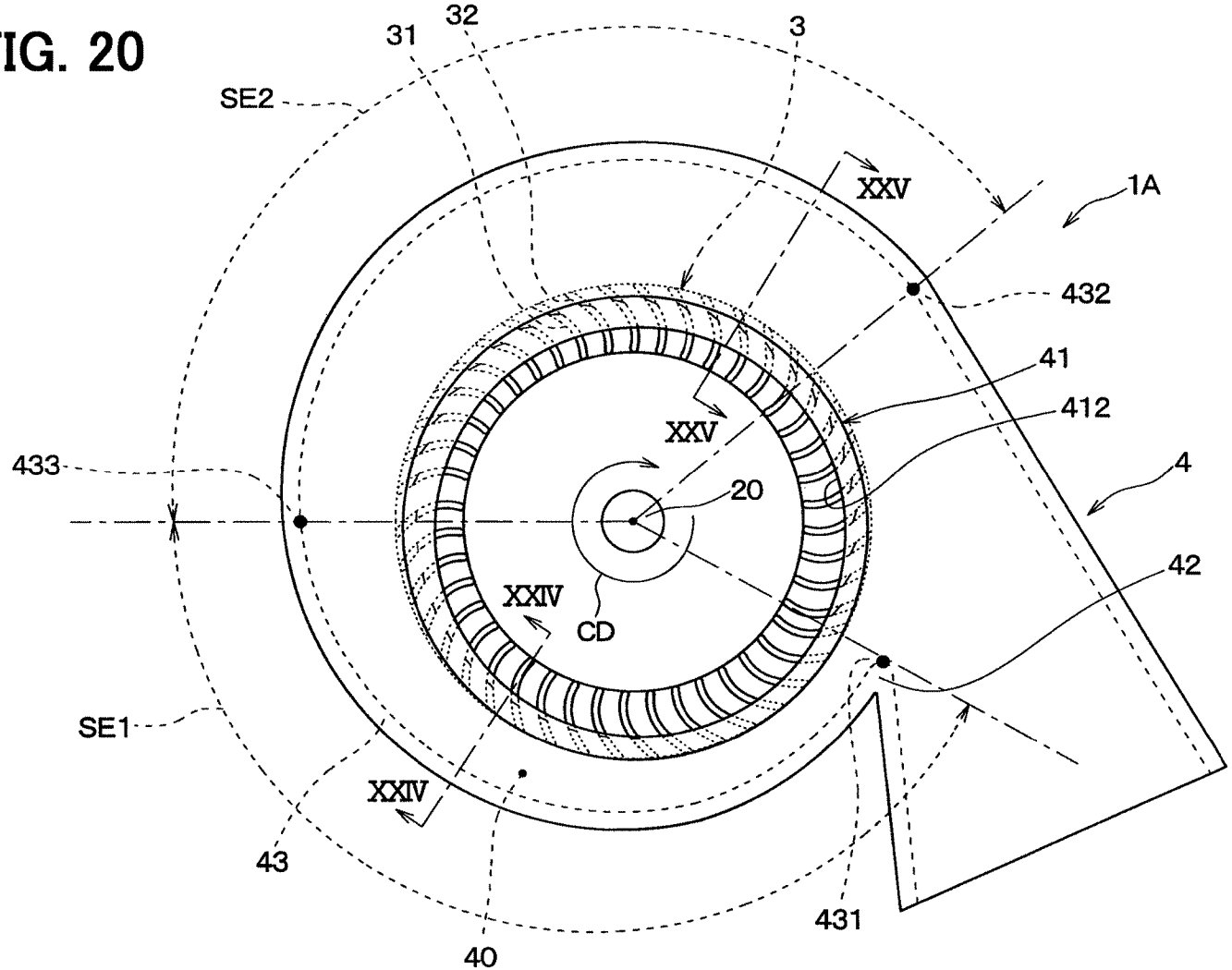
FIG. 20 is a top view illustrating the centrifugal blower viewed in a direction of an arrow XX of FIG. 18.

A casing 4 of the centrifugal blower 1A according to this embodiment is, similarly to the centrifugal blower 1 of the first embodiment, a scroll casing including a side wall portion 43 that defines an airflow passage 40 having a volute shape outside an impeller 3, as shown in FIGS. 18 to 20. The casing 4 includes a nose portion 42 as a starting point of the airflow passage.

The side wall portion 43 of the casing 4 extends from a scroll start portion 431 that is positioned at the nose portion 42 of the side wall portion 43 to a scroll end portion 432 such that a distance (radius) from an axis line CL of a rotation shaft increases in a logarithmic spiral shape. A cross sectional area of the casing 4 increases in size from the scroll start portion 431 toward the scroll end portion 432 of the side wall portion 43. The scroll start portion 431 may be a scroll start point, and the scroll end portion 432 may be a scroll end point.

When the casing 4 configured from a scroll casing as in the present embodiment, a distance between a trailing edge of a blade 31 of the impeller 3 and the side wall portion 43 increases from the scroll start portion 431 toward the scroll end portion 432. Specifically, the distance between the trailing edge of the blade 31 and the side wall portion 43 is the shortest at the scroll start portion 431 of the side wall portion 43 and largest at the scroll end portion 432.

Therefore, in the casing 4 of the present embodiment includes an area where an airflow is likely to be disturbed and an area where an airflow is unlikely to be disturbed on an air discharge side of the impeller 3 in a rotation direction CD.

For example, since the side wall portion 43 works as a resistance to the airflow in an area SE1 extending from the scroll start portion 431 to an intermediate portion 433 in the rotation direction CD shown in FIGS. 19 and 20, the turbulence of the airflow on an air discharge side of the impeller 3 tends to be likely to be generated. The intermediate portion 433 may be an intermediate point.

On the other hand, since the side wall portion 43 scarcely works as a resistance to the airflow in an area SE2 from the intermediate portion 433 to the scroll end portion 432 shown in FIGS. 19 and 20, the turbulence of the airflow on the air discharge side of the impeller 3 tends to be unlikely to be generated.

As described in the first embodiment, the centrifugal blower 1 of the first embodiment is capable of reducing a noise and improving a blowing efficiency compared to the centrifugal blower CE of the comparative example.

Figure 21:
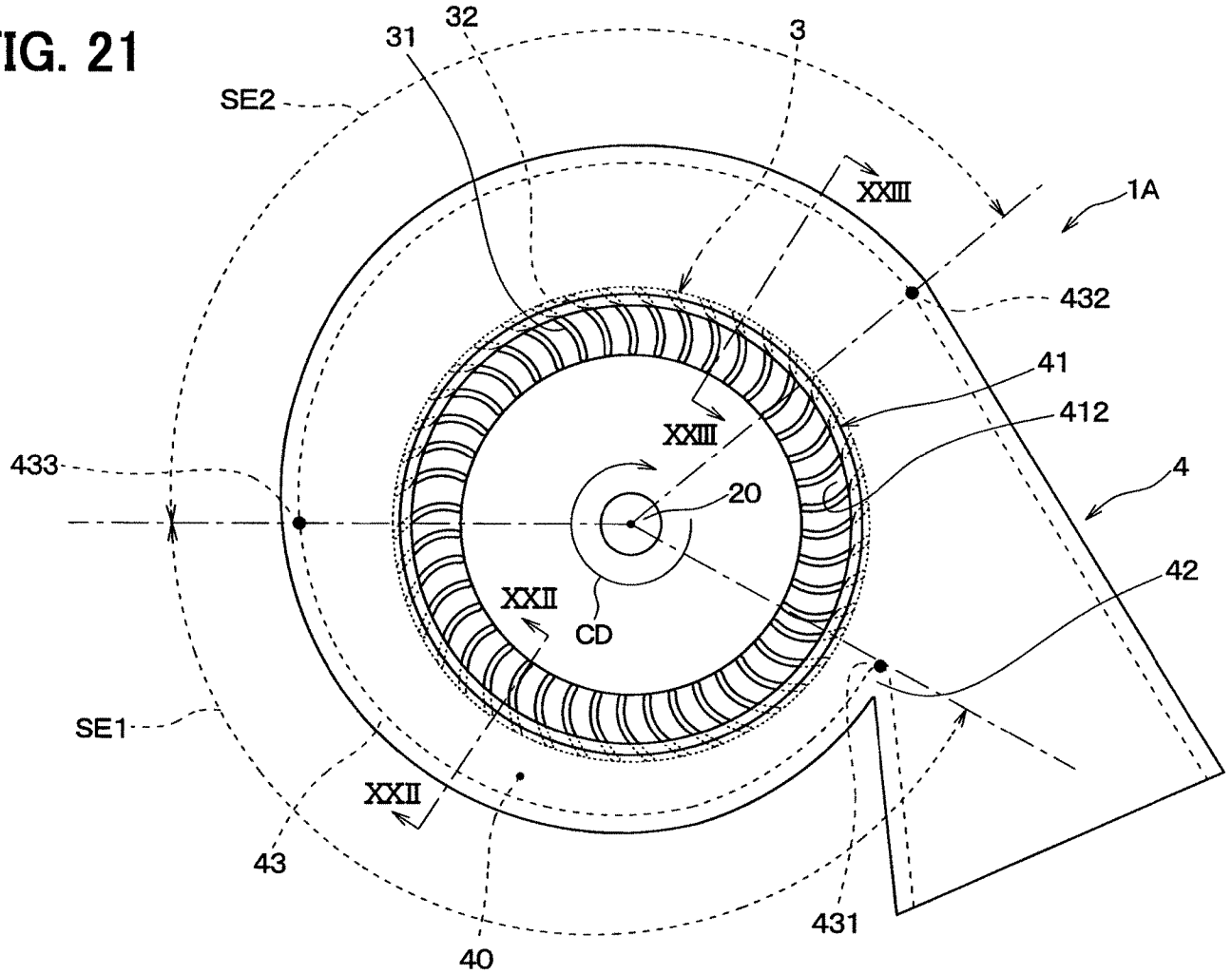
FIG. 21 is a top view illustrating the centrifugal blower according to the first embodiment.

The inventors of the present disclosure had studied a loudness of the noise generated in the centrifugal blower 1 for the sake of further reducing the noise. As a result, the inventors found that the noise in a vicinity of the scroll end portion 432 of the side wall portion 43 shown in FIG. 21 is large compared to the noise in the area SE1 extending from the scroll start portion 431 to the intermediate portion 433 of the side wall portion 43 in the rotation direction CD.

Next, the inventors had studied airflow in the area SE1 extending from the scroll start portion 431 to the intermediate portion 433 of the side wall portion 43 in the rotation direction CD and in the vicinity of the scroll end portion 432 of the side wall portion 43.

Figure 22:
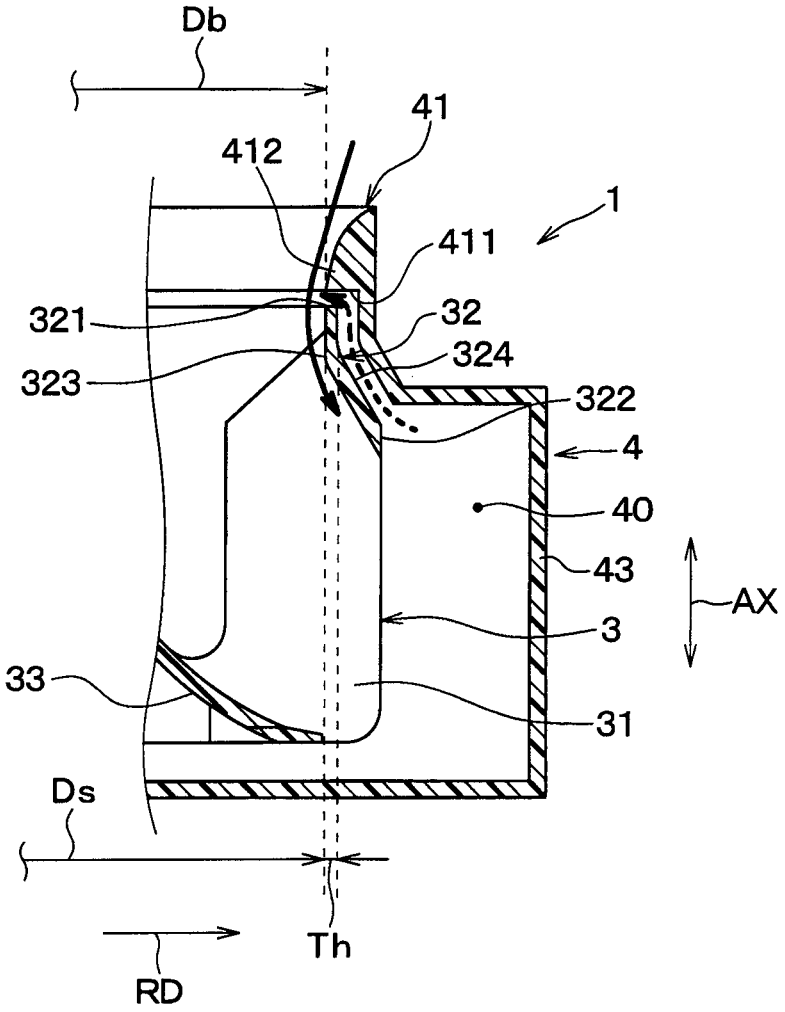
FIG. 22 is a sectional diagram taken along a XXII-XXII line of FIG. 21.
Figure 23:
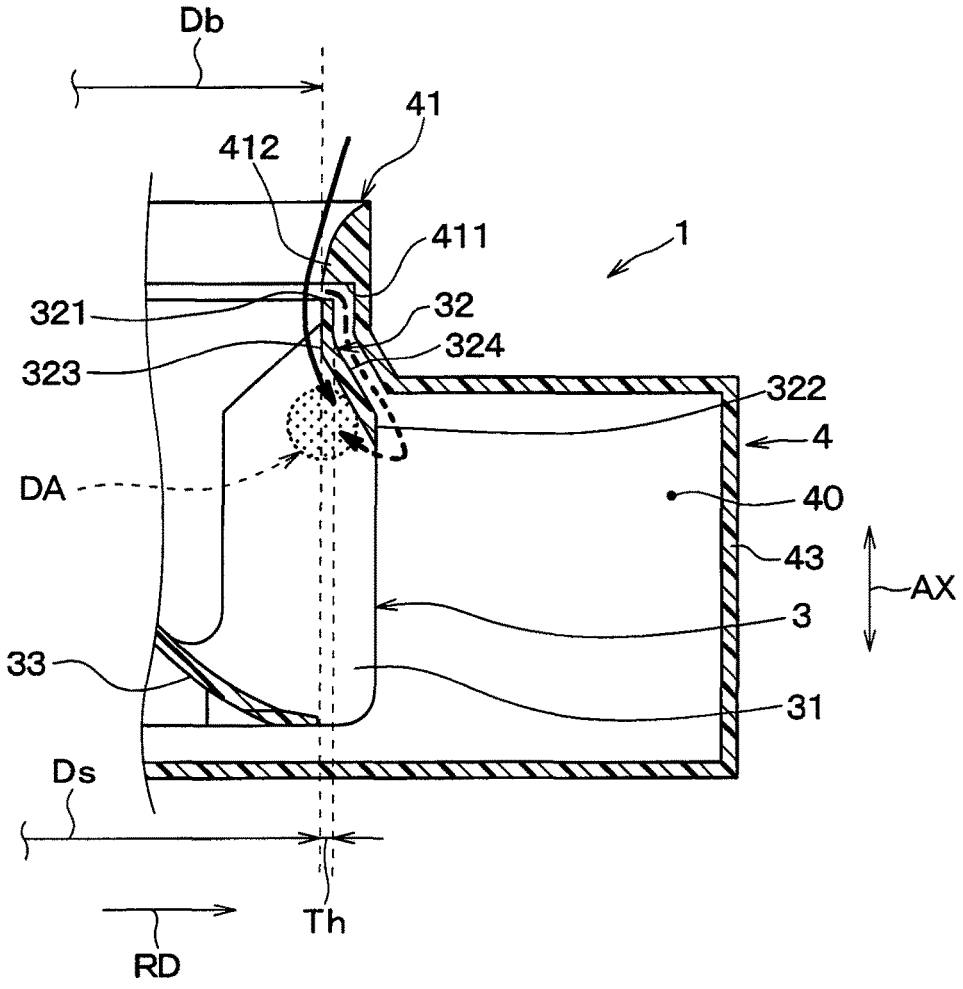
FIG. 23 is a sectional diagram taken along a XXIII-XXIII line of FIG. 21.
Figure 24:
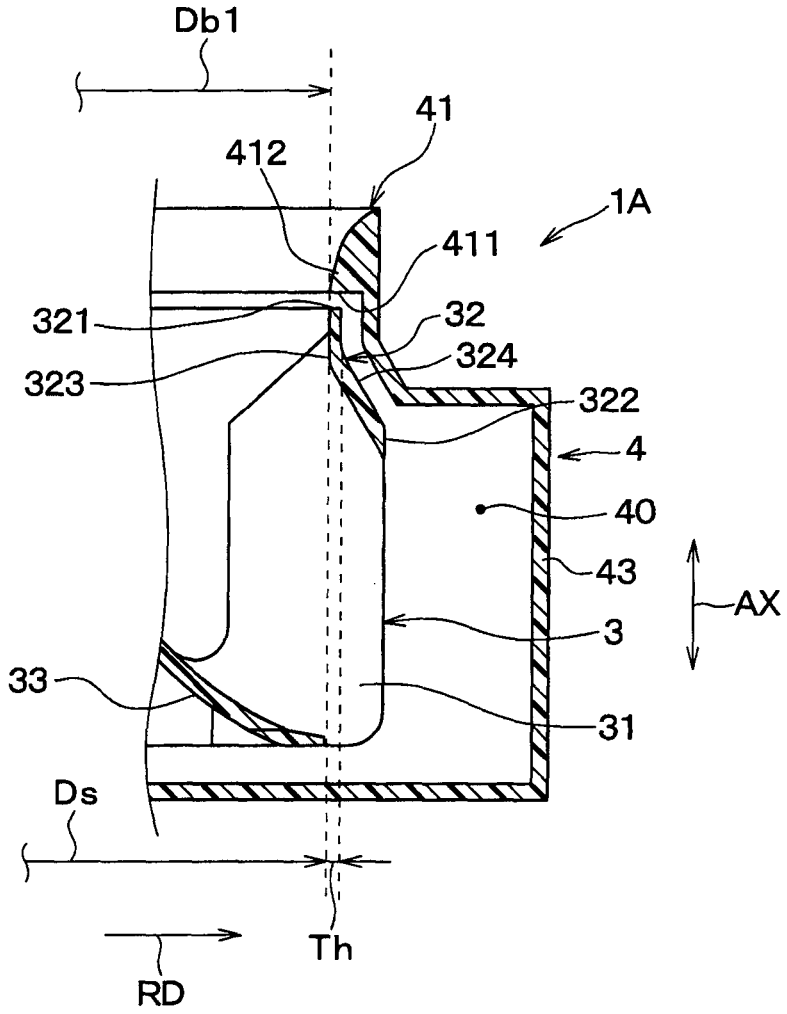
FIG. 24 is a sectional diagram taken along a XXIV-XXIV line of FIG. 20.

As a result, the inventors found that, in the centrifugal blower 1 of the first embodiment, the air flowing into a vicinity of a surface of the air intake portion 41 flows along the side panel 32 in the area SE1 extending from the scroll start portion 431 of the side wall portion 43 in the rotation direction CD, as shown in FIG. 22.

The inventors further found that a part of the air discharged from the air discharge side of the impeller 3 tends to flow back to an air intake side of the impeller 3 through a gap between the air intake portion 41 and the side panel 32, in the area SE1 extending from the scroll start portion 431 to the intermediate portion 433 of the side wall portion 43 in the rotation direction CD. That is because, as described above, the side panel 32 works as a resistance to the airflow in the area SE1 extending from the scroll start portion 431 to an intermediate portion 433 in the rotation direction CD.

On the other hand, the inventors found that the air flowing into the vicinity of the surface of the air intake portion 41 flows along the side panel 32 in the vicinity of the scroll end portion 432 of the side wall portion 43.

Moreover, the inventors found that a part of the air flowing into the vicinity of the surface of the air intake portion 41 tends to flow to the air discharge side of the impeller 3 through the gap between the air intake portion 41 and the side panel 32 in the vicinity of the scroll end portion 432 of the side wall portion 43. That is because the number of elements that work as a resistance on the air discharge side of the impeller 3 in the vicinity of the scroll end portion 432 of the side wall portion 43 is small compared to the area SE1 extending from the scroll start portion 431 to the intermediate portion 433 of the side wall portion 43 in the rotation direction CD.

The inventors further found that the air flowing into the vicinity of the air intake portion 41 and the air flowing through the gap between the air intake portion 41 and the side panel 32 may tend to collide with each other in a separation area DA in which the airflow in the vicinity of the side panel 32 may be likely to be separated. The collision of the airflows like this may cause the noise.

According to the study by the inventors of the present disclosure, a direction of the air flowing through the gap between the air intake portion 41 and the side panel 32 tend to vary according to the rotation direction CD.

According to the result of the study by the inventors of the present disclosure, it may be inferred that the noise may be large in the vicinity of the scroll end portion 432 of the side wall portion 43 because the airflows opposing each other in the separation area DA collide with each other.

In the centrifugal blower 1A of the present embodiment, substantially no level difference in a radial direction RD is provided between the air intake portion 41 and the side panel 32 in a part in the rotation direction.

Specifically, substantially no level difference in the radial direction RD is provided between the air intake portion 41 and the side panel 32 in the area SE1 extending from the scroll start portion 431 to the intermediate portion 433 of the side wall portion 43 in the rotation direction CD of the centrifugal blower 1A according to the present embodiment shown in FIGS. 19 and 20. In the centrifugal blower 1A of the present embodiment, the difference in size between a radius Db1 of the downstream end portion 411 of the air intake portion 41 and a radius Ds of the first end portion 321 of the side panel 32 is equal to or smaller than the thickness Th of the side panel 32 in the area SE1 extending from the scroll start portion 431 to the intermediate portion 433 of the side wall portion 43 in the rotation direction CD.

On the other hand, in a part in the rotation direction CD of the rotation shaft 20 of the centrifugal blower 1A of the present embodiment, a level difference in the radial direction RD is provided between the air intake portion 41 and the side panel 32.

Figure 25:
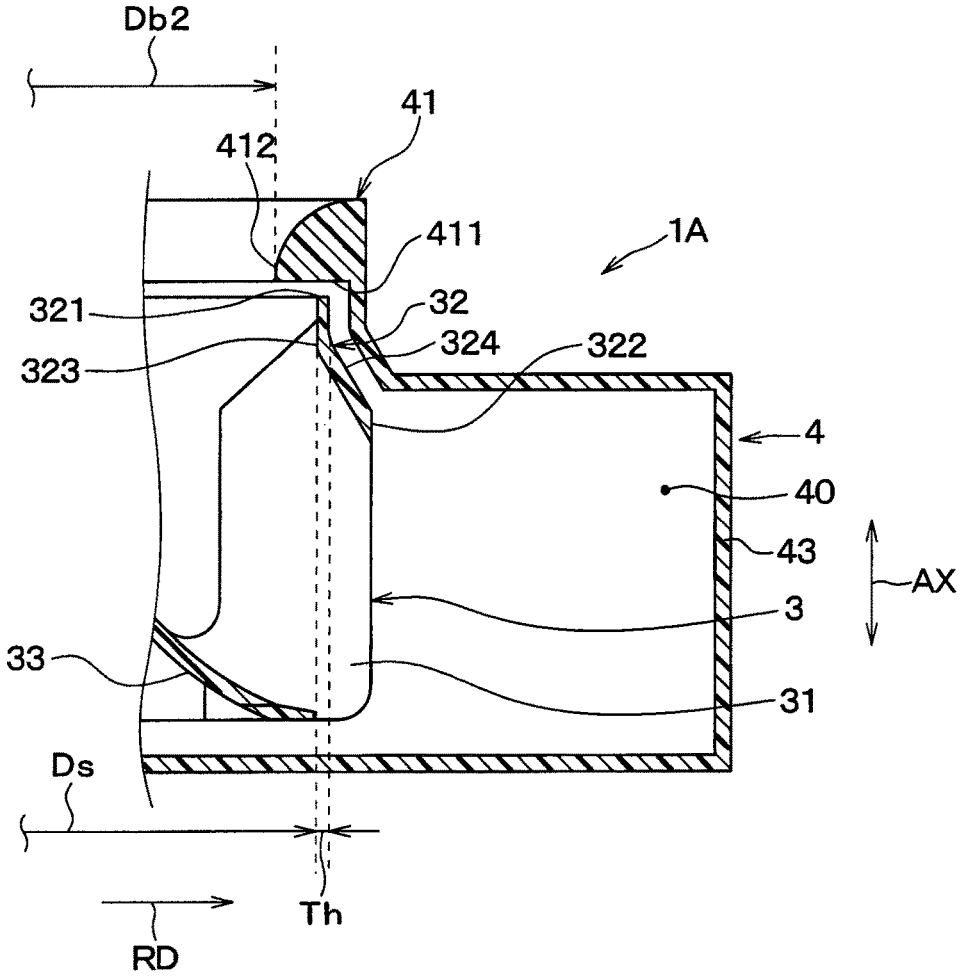
FIG. 25 is a sectional diagram taken along a XXV-XXV line of FIG. 20.

Specifically, in the vicinity of the scroll end portion 432 of the side wall portion 43 of the centrifugal blower 1A according to the present embodiment shown in FIGS. 19 and 20, a level difference is provided between the air intake portion 41 and the side panel 32 as shown in FIG. 25. In the vicinity of the scroll end portion 432 of the side wall portion 43 of the centrifugal blower 1A according to the present embodiment, a difference in size between a radius Db2 of the downstream end portion 411 of the air intake portion 41 and the radius Ds of the first end portion 321 of the side panel 32 is larger than the thickness Th of the side panel 32. The radius Db2 of the downstream end portion 411 of the air intake portion 41 is smaller in size than the radius Ds of the first end portion 321 of the side panel 32.

In the area SE2 from the intermediate portion 433 to the vicinity of the scroll end portion 432 of the side wall portion 43 of the centrifugal blower 1A according to the present embodiment, the difference in size between the radius Db of the downstream end portion 411 of the air intake portion 41 and the radius Ds of the first end portion 321 of the side panel 32 continuously increases in a rotation direction CD of the rotation shaft 20.

In an area extending from the scroll end portion 432 to the scroll start portion 431 of the side wall portion 43 in the rotation direction CD of the centrifugal blower 1A according to the present embodiment, the difference in size between the radius Db of the downstream end portion 411 of the air intake portion 41 and the radius Ds of the first end portion 321 of the side panel 32 continuously decreases in the rotation direction CD. The difference in size between the radius Db of the downstream end portion 411 of the air intake portion 41 and the radius Ds of the first end portion 321 of the side panel 32 may vary discontinuously, not continuously.

Figure 26:
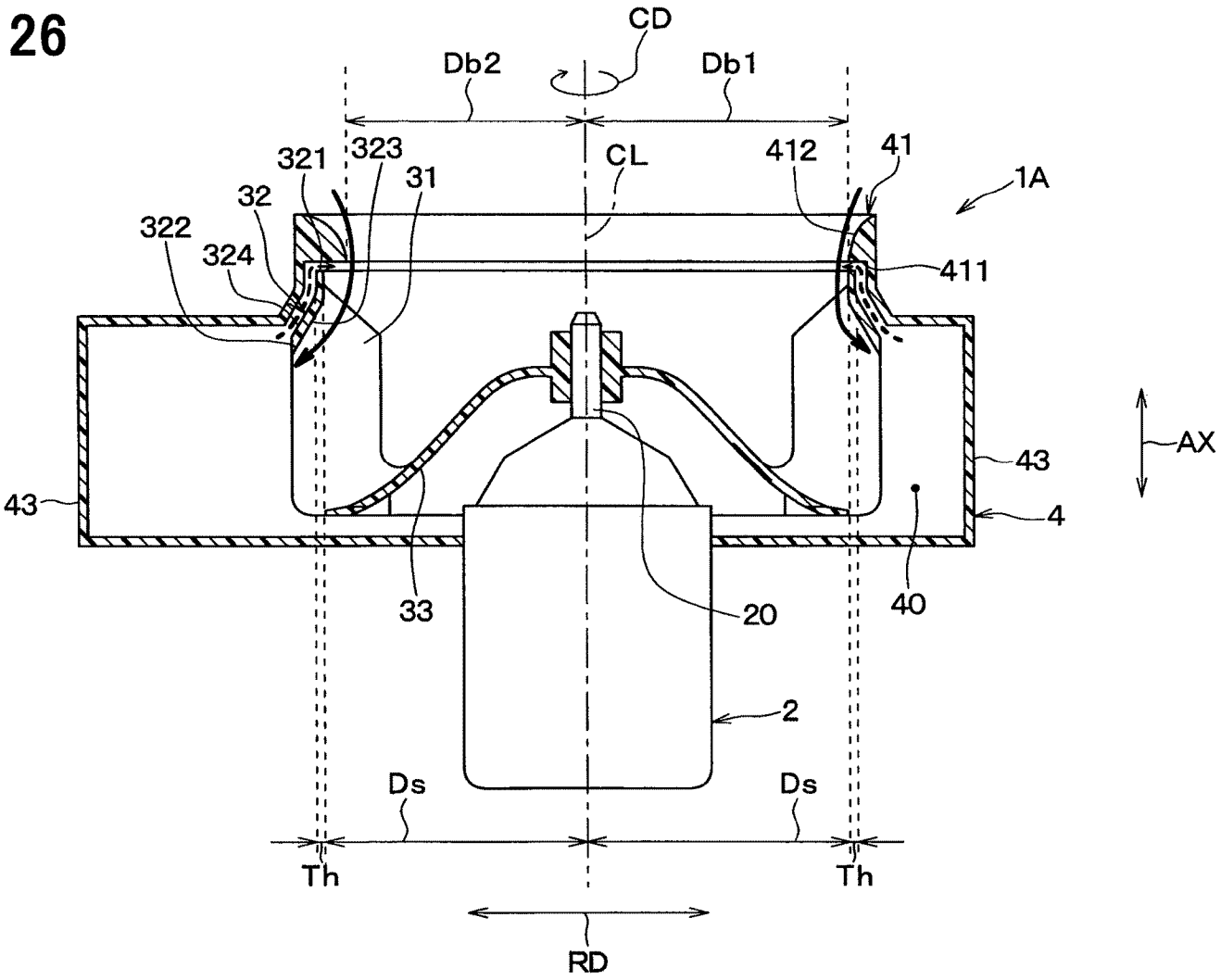
FIG. 26 is a sectional diagram illustrating the centrifugal blower according to the fourth embodiment.

Next, actuations of the centrifugal blower 1A of the present embodiment will be described below referring to FIG. 26. In FIG. 26, a cross section of the vicinity of the scroll start portion 431 of the side wall portion 43 is illustrated in the right-hand side, and a cross section of the vicinity of the scroll end portion 432 of the side wall portion 43 is illustrated in the left-hand side.

As shown in FIG. 26, the difference in size between the radius Db1 of the downstream end portion 411 of the air intake portion 41 and the radius Ds of the first end portion 321 of the side panel 32 is equal to or smaller than the thickness Th of the side panel 32 in the vicinity of the scroll start portion 431 of the centrifugal blower 1A according to the present embodiment.

Therefore, in the vicinity of the scroll start portion 431 of the centrifugal blower 1A according to the present embodiment, the air flowing along the air intake portion 41 is likely to flow to the side panel 32 smoothly. Moreover, in the vicinity of the scroll start portion 431 of the centrifugal blower 1A according to the present embodiment, the airflow on the air discharge side of the impeller 3 flows back to the air intake side of the impeller 3 through the gap between the air intake portion 41 and the side panel 32.

In the vicinity of the scroll end portion 432 of the centrifugal blower 1A according to the present embodiment, the difference in size between the radius Db2 of the downstream end portion 411 of the air intake portion 41 and the radius Ds of the first end portion 321 of the side panel 32 is larger than the thickness Th of the side panel 32.

Accordingly, the air flowing along the air intake portion 41 is separated from the side panel 32 in the vicinity of the scroll end portion 432 of the side wall portion 43, but the airflow in the vicinity of the surface of the air intake portion 41 may not flow to the air discharge side of the impeller 3 through the gap between the air intake portion 41 and the side panel 32. In the vicinity of the scroll end portion 432 of the centrifugal blower 1A according to the present embodiment, the air on the air discharge side of the impeller 3 flows back to the air intake side of the impeller 3 through the gap between the air intake portion 41 and the side panel 32.

The other configurations are same as the first embodiment. Therefore, the centrifugal blower 1A is capable of obtaining the effects obtained by the same configuration as the first embodiment. In the area SE1 extending from the scroll start portion 431 to the intermediate portion 433 of the side wall portion 43 in the rotation direction CD of the centrifugal blower 1A according to the present embodiment, the difference in size between the radius of a part of the inner wall surface portion 412 of an air intake portion 41 having the smallest radius in the inner wall surface portion 412 and a radius of a part of the inner panel surface portion 323 of the side panel 32 having the smallest radius in the inner panel surface portion 323 is equal to or smaller than the thickness Th of the side panel 32 in the area SE1 extending from the scroll start portion 431 to the intermediate portion 433 of the side wall portion 43 in the rotation direction CD.

According to this, in the area SE1 extending in the rotation direction CD from the scroll start portion 431 to the intermediate portion 433 of the side wall portion 43 in which the turbulence of the airflow is likely to be generated, substantially no level difference in the radial direction RD is provided between the inner wall surface portion 412 of the air intake portion 41 and the inner panel surface portion 323 of the side panel 32. Accordingly, since the air flowing along the air intake portion 41 is likely to flow to the side panel 32 smoothly in an area of the casing 4 in which the turbulence of the airflow is likely to be generated, the noise in the centrifugal blower 1A can be reduced, and the blowing efficiency can be improved.

In the centrifugal blower 1A of the present embodiment, the difference in size between the part of the air intake portion 41 having the smallest radius therein and the part of the side panel 32 having the smallest radius therein in the vicinity of the scroll end portion 432 of the side wall portion 43 is larger than that in the area extending from the scroll start portion 431 to the intermediate portion 433 in the rotation direction CD. The difference in size between the part of the air intake portion 41 having the smallest radius therein and the part of the side panel 32 having the smallest radius therein in a cross section including the rotation shaft 20 and the scroll end portion 432 taken along the axial direction may be larger than that in a cross section including the rotation shaft 20 and a part of the area SE1 taken along the axial direction.

In the vicinity of the scroll end portion 432 of the side wall portion 43, the level difference in the radial direction RD between the inner wall surface portion 412 of the air intake portion 41 and the inner panel surface portion 323 of the side panel 32 is provided. Therefore, the airflow in the vicinity of the air intake portion 41 flowing to the air discharge side of the impeller 3 through the gap in the axial direction between the air intake portion 41 and the side panel 32 can be limited. In the centrifugal blower 1A of the present embodiment, the noise caused by the collision of the airflows in the vicinity of the scroll end portion 432 of the side wall portion 43 can be limited. Accordingly, the centrifugal blower 1A of the present embodiment can reduce the noise compared to the centrifugal blower 1 of the first embodiment.

In the vicinity of the scroll end portion 432 of the centrifugal blower 1A according to the present embodiment, the difference in size between the radius of the part of the inner wall surface portion 412 of the air intake portion 41 having the smallest radius in the inner wall surface portion 412 and the radius of the part of the inner panel surface portion 323 of the side panel 32 having the smallest radius in the inner panel surface portion 323 is larger than the thickness Th of the side panel 32.

According to this, in the vicinity of the scroll end portion 432 of the side wall portion 43, the level difference in the radial direction RD larger than the thickness Th of the side panel 32 is provided between the inner wall surface portion 412 of the air intake portion 41 and the inner panel surface portion 323 of the side panel 32. Therefore, the airflow in the vicinity of the surface of the air intake portion 41 flowing to the air discharge side through the air intake portion 41 and the side panel 32 can be further limited.

In the present embodiment, an example is described, in which the difference in size of the radius of the part of the inner wall surface portion 412 having the smallest radius therein and the radius of the part of the inner panel surface portion 323 having the smallest therein in the vicinity of the scroll end portion 432 is larger than the thickness Th of the side panel 32. However, the present disclosure is not limited to this. For example, the difference in size of the radius of the part of the inner wall surface portion 412 having the smallest radius therein and the radius of the part of the inner panel surface portion 323 having the smallest therein may be equal to or smaller than the thickness Th of the side panel 32 as long as the level difference in the radial direction between the air intake portion 41 and the side panel 32 is provided in the vicinity of the scroll end portion 432.

Although the present disclosure has been fully described in connection with the preferred embodiments thereof with reference to the accompanying drawings, it is to be noted that various changes and modifications will become apparent to those skilled in the art.

In the above-described embodiments, the centrifugal blower 1, 1A is used in a blowing unit of an air conditioning device for a vehicle. However, the present disclosure is not limited to this. For example, the centrifugal blower 1, 1A can be used in a seat air conditioning device for a vehicle. Moreover, the centrifugal blower 1, 1A is not limited to be for a vehicle but can be used in a stationary air conditioner or a ventilation device.

In the above-described embodiments, the impeller 3 is formed of a multi-blade centrifugal fan (sirocco fan) in which a forward curved blade is used as the blade 31, however, the impeller 3 is not limited to this. The impeller 3 may be formed of a turbofan in which a backward curved blade is used as each blade 31.

In the above-described embodiments, the casing 4 is a scroll casing, however, the casing 4 is not limited to this. A 360 degrees blowing type casing 4 may be adopted. When the casing 4 is configured from the 360 degrees blowing type casing, a direction of the air flowing through the gap between the air intake portion 41 and the side panel 32 may be unlikely to be changed in the rotation direction of the rotation shaft 20. Therefore, when the casing 4 is configured from the 360 degrees blowing type casing, it may be preferred that substantially no level difference between the air intake portion 41 and the side panel 32 is provided entirely in the rotation direction, as in the first to third embodiments.

The radius Db of the downstream end portion 411 of the air intake portion 41 may be preferred to be equal to or smaller than the radius Ds of the first end portion 321 of the side panel 32 as in the first to third embodiments. However, the present disclosure is not limited to this. The radius Db of the downstream end portion 411 may be set to be larger in size than the radius Ds of the first end portion 321 as long as the difference in size between the radius of the inner wall surface portion 412 having the smallest radius therein and the radius of the inner panel surface portion 323 having the smallest radius therein is equal to or smaller than the thickness Th.

Both the tangent line to the downstream end portion 411 of the air intake portion 41 and the tangent line to the first end portion 321 of the side panel 32 may be preferred to be set to extend in a direction along the axial direction AX of the rotation shaft 20. However, the present disclosure is not limited to this. Both the tangent line to the downstream end portion 411 of the air intake portion 41 and the tangent line to the first end portion 321 of the side panel 32 may extend in a direction slightly tilted to the axial direction AX of the rotation shaft 20.

In the second and third embodiments, the deflection passage 5 is provided between the air intake portion 41 and the side panel 32. However, the present disclosure is not limited to this. For example, a backflow limiting portion such as a labyrinth seal may be provided between the air intake portion 41 and the side panel 32.

It is needless to say that components described in the above-described embodiments is not essential excepting the case where that is explicitly described to be essential or that is obviously essential in principle.

In the above-described embodiments, when the number, numerical value, quantity, numerical ranges, etc. of components are mentioned, it is not intended to be limited to the particular number excepting a case where the component is apparently limited to the particular number in principle or it is explicitly described to be essential.

Further, in the above-described embodiments, when the shapes, the positional relationships and the like of the components are mentioned, it is not intended to be limited to the particular shapes or the positional relationships excepting a case where the component is apparently limited to the particular shapes or positional relationships in principle or it is explicitly described to be essential.

According to a first aspect described in a part or whole of the above-described embodiments, in the centrifugal blower, the downstream end portion of the air intake portion and the upstream end portion of the side panel are spaced from each other in the axial direction of the rotation shaft and faces each other in the axial direction. The difference in size between the radius of the part of the inner wall surface portion having the smallest radius therein and the radius of the part of the inner panel surface portion having the smallest radius therein is set to be equal to or smaller than the thickness of the side panel.

According to a second aspect, the radius of the part of the inner wall surface portion having the smallest radius therein is set to be equal to or smaller in size than the radius of the part of the inner panel surface portion. According to this, the collision of the air flowing along the air intake portion with the side panel can be limited.

According to a third aspect, the casing of the centrifugal blower is configured from the scroll casing that includes the side wall portion defining the airflow passage having a volute shape outside the impeller. In at least a part of an area extending from the scroll start portion to the intermediate portion in the rotation direction, the difference in size between the radius of the part of the inner wall surface portion having the smallest radius therein and the radius of the part of the inner panel surface portion having the smallest radius therein is set to be equal to or smaller than the thickness of the side panel.

According to this, in at least of a part of the area extending from the scroll start portion to the intermediate portion in the rotation direction where the turbulence of the airflow is likely to be generated, substantially no level difference in the radial direction between the inner wall surface portion and the inner panel surface portion is provided. Since the air flowing along the air intake portion is likely to flow to the side panel smoothly in the part of the casing where the turbulence is likely to be generated, the noise can be decreases, and the blowing efficiency is improved.

According to the fourth aspect, the difference in size between the part of the air intake portion having the smallest radius therein and the part of the side panel having the smallest radius therein in the vicinity of the scroll end portion of the side wall portion is larger than that in the area extending from the scroll start portion to the intermediate portion in the rotation direction.

According to this, the level difference in the radial direction between the inner wall surface portion of the air intake portion and the inner panel surface portion of the side panel is provided in the vicinity of the scroll end portion of the side wall portion. Therefore, the airflow in the vicinity of the surface of the air intake portion flowing to the air discharge side of the impeller through the gap between the air intake portion and the side panel can be reduced. Since the noise in the vicinity of the scroll end portion caused by a collision of the airflows can be limited, the noise in the centrifugal blower can be further reduced.

According to a fifth aspect, in a part of the air intake portion and the side panel corresponding to the scroll end portion of the side wall portion, the difference in size between the radius of the part of the inner wall surface portion having the smallest therein and the radius of the part of the inner panel surface portion having the smallest therein is larger than the thickness of the side panel.

According to this, the level difference in the radial direction larger in size than the thickness of the side panel is provided in the vicinity of the scroll end portion. Therefore, the airflow in the vicinity of the surface of the air intake portion is further limited not to flow to the air discharge side of the impeller through the gap between the air intake portion and the side panel.

According to a sixth aspect, the deflection passage is provided between the air intake portion and the side panel. The deflection passage deflects the backflow flowing from the gap between the downstream end portion and the upstream end portion to the air intake side of the impeller so as to be closer to the main flow flowing from the air intake portion to the air intake side of the impeller. When the deflection portion deflects the backflow so as to be closer to the main flow, the interference of the main flow and the backflow can be limited. Since the air flowing along the air intake portion becomes likely to flow to the side panel smoothly, the noise can be reduced, and the blowing efficiency can be improved.

According to a seventh aspect, a specific configuration of the deflection passage is described. Specifically, the deflection passage includes the gap between the downstream end portion and the upstream end portion. The downstream end portion is angled to the inner wall surface portion so that the radius of the part facing to the upstream end portion becomes smaller as the part becomes closer to the upstream end portion.

If a facing surface of the upstream end facing to the downstream end portion extends in the radial direction of the rotation shaft, the area of the cross section of the gap between the upstream end portion and the downstream end portion becomes small toward the downstream. In this case, the backflow flowing in the gap between the upstream end portion and the downstream end portion may be likely to be disturbed.

With considering this point, the upstream end portion is angled such that the radius of the part of the upstream end portion facing to the downstream end portion becomes large as the upstream end portion becomes closer to the downstream end portion. According to this, the interference of the main flow and the backflow can be limited because the turbulence of the backflow in the gap between the upstream end portion and the downstream end portion. Since the air flowing along the air intake portion becomes likely to flow to the side panel smoothly, the noise can be reduced, and the blowing efficiency can be improved.

Additional advantages and modifications will readily occur to those skilled in the art. The disclosure in its broader terms is therefore not limited to the specific details, representative apparatus, and illustrative examples shown and described.

What is claimed is:

1. A centrifugal blower comprising:

a rotation shaft;

an impeller having a circular cylindrical shape and rotating about an axis line of the rotation shaft to draw an air therein in an axial direction of the rotation shaft and discharge the air outward in a radial direction of the rotation shaft, the impeller including a plurality of blades arranged radially about the axis line of the rotation shaft, and a side panel having an annular shape and connecting end parts of the plurality of blades in the axial direction of the rotation shaft; and a casing accommodating the impeller and including an air intake portion positioned adjacent to the side panel, the air intake portion having a bell mouth shape through which the drawn air is guided to an inside of the impeller, wherein the air intake portion includes a downstream end portion that is an end portion of the air intake portion located downstream of an airflow, and an inner wall surface located on an inner side of the air intake portion in the radial direction of the rotation shaft;

the side panel includes an upstream end portion that is an end portion of the side panel located upstream of the airflow, and an inner panel surface that is an inner surface of the side panel located on an inner side of the side panel in the radial direction of the rotation shaft;

the downstream end portion and the upstream end portion face each other across a space in the axial direction of the rotation shaft at least in an angular range in the rotation direction;

a difference between a smallest inner radius of the inner wall surface of the air intake portion and a smallest inner radius of the inner panel surface is smaller than or equal to a thickness of the side panel at least in the angular range;

the smallest inner radius of the inner wall surface of the air intake portion is equal to or smaller than the smallest inner radius of the inner panel surface;

the casing is a scroll casing that includes a side wall portion defining an airflow passage having a volute shape on an outside of the impeller;

the angular range is located within a sector spreading in the rotation direction from a radius of the side wall portion on a scroll start point of the casing to a radius of the side wall portion on an intermediate point of the casing, the intermediate point being located at a middle position between the scroll start point and a scroll end point of the casing in the rotation direction; and the difference between the smallest inner radius of the inner wall surface of the air intake portion and the smallest inner radius of the inner panel surface is larger on a radius of the side wall portion on the scroll end point than in the sector from the radius on the scroll start point to the radius on the intermediate point in the rotation direction.

2. The centrifugal blower according to claim 1, wherein the difference between the smallest inner radius of the inner wall surface of the air intake portion and the smallest inner radius of the inner panel surface is larger than the thickness of the side panel, on the radius on the scroll end point.

3. The centrifugal blower according to claim 1, further including a deflection passage between the air intake portion and the side panel, the deflection passage deflecting a direction of a backflow flowing through a gap between the downstream end portion and the upstream end portion toward an air intake side of the impeller such that the backflow is deflected to be closer to a main flow flowing from the air intake portion toward the air intake side of the impeller.

4. The centrifugal blower according to claim 3, wherein the deflection passage includes the gap between the downstream end portion and the upstream end portion; and the downstream end portion includes a downstream end surface facing the upstream end portion, the downstream end surface being angled to the inner wall surface such that a radius of the downstream end surface about the rotation shaft decreases in a downstream direction of the main flow.

5. The centrifugal blower according to claim 4, wherein the upstream end portion includes an upstream end surface facing the downstream end portion, the upstream end surface being angled to the inner panel surface such that a radius of the upstream end surface about the rotation shaft increases in an upstream direction of the main flow.

6. A centrifugal blower comprising:

a rotation shaft;

an impeller having a circular cylindrical shape and rotating about an axis line of the rotation shaft to draw an air therein in an axial direction of the rotation shaft and discharge the air outward in a radial direction of the rotation shaft, the impeller including a plurality of blades arranged radially about the axis line of the rotation shaft, and a side panel having an annular shape and connecting end parts of the plurality of blades in the axial direction of the rotation shaft;

a casing accommodating the impeller and including an air intake portion positioned adjacent to the side panel, the air intake portion having a bell mouth shape through which the drawn air is guided to an inside of the impeller;

the air intake portion includes a downstream end portion that is an end portion of the air intake portion located downstream of an airflow, and an inner wall surface located on an inner side of the air intake portion in the radial direction of the rotation shaft;

the side panel includes an upstream end portion that is an end portion of the side panel located upstream of the airflow, and an inner panel surface that is an inner surface of the side panel located on an inner side of the side panel in the radial direction of the rotation shaft; and a deflection passage between the air intake portion and the side panel, the deflection passage deflecting a direction of a backflow flowing through a gap between the downstream end portion and the upstream end portion toward an air intake side of the impeller such that the backflow is deflected to be closer to a main flow flowing from the air intake portion toward the air intake side of the impeller, wherein the downstream end portion and the upstream end portion face each other across a space in the axial direction of the rotation shaft at least in an angular range in the rotation direction;

a difference between a smallest inner radius of the inner wall surface of the air intake portion and a smallest inner radius of the inner panel surface is smaller than or equal to a thickness of the side panel at least in the angular range;

the downstream end portion includes a downstream end surface;

the upstream end portion includes an upstream end surface;

the downstream end surface and the upstream end surface face each other across the deflection passage; and the downstream end surface extends outward from the inner wall surface of the air intake portion in the radial direction of the rotation shaft and is inclined away from the upstream end surface in the axial direction.

* * * * *